US012059060B2

(12) United States Patent
Sabir

(10) Patent No.: US 12,059,060 B2
(45) Date of Patent: Aug. 13, 2024

(54) FASTENER SYSTEMS, METHODS, AND ARTICLES

(71) Applicant: ADMIRAL CLOTHING & ACCESSORIES INC., Calgary (CA)

(72) Inventor: Aaliya Sabir, Calgary (CA)

(73) Assignee: ADMIRAL CLOTHING & ACCESSORIES, INC., Calgary (CA)

( * ) Notice: Subject to any disclaimer, the term of this patent is extended or adjusted under 35 U.S.C. 154(b) by 121 days.

(21) Appl. No.: 17/801,696

(22) PCT Filed: Feb. 24, 2021

(86) PCT No.: PCT/CA2021/050216

§ 371 (c)(1),
(2) Date: Aug. 23, 2022

(87) PCT Pub. No.: WO2021/168559

PCT Pub. Date: Sep. 2, 2021

(65) Prior Publication Data

US 2023/0157420 A1 May 25, 2023

Related U.S. Application Data

(60) Provisional application No. 62/980,985, filed on Feb. 24, 2020.

(51) Int. Cl.
*A44B 11/00* (2006.01)
*A41D 23/00* (2006.01)

(52) U.S. Cl.
CPC ..... *A44B 11/006* (2013.01); *A41D 23/00* (2013.01); *A41D 2300/324* (2013.01)

(58) Field of Classification Search
CPC ... A44B 11/006; A44B 11/34; A44B 17/0023; A41D 2300/324
See application file for complete search history.

(56) References Cited

U.S. PATENT DOCUMENTS 2,435,082 A 1/1948 Huber
2,477,575 A * 8/1949 Bubser, Jr. ..... B64D 17/32 24/701

(Continued)

FOREIGN PATENT DOCUMENTS

CA 3169154 A1 9/2021
DE 102016008652 A1 1/2018
WO WO-2021168559 A1 9/2021

OTHER PUBLICATIONS

International Application Serial No. PCT/CA2021/050216, International Preliminary Report on Patentability mailed Sep. 9, 2022, 10 pgs.

(Continued)

*Primary Examiner* — Robert Sandy
(74) *Attorney, Agent, or Firm* — SCHWEGMAN LUNDBERG & WOESSNER, P.A.

(57) ABSTRACT

A fastener system for clothing and other personal items is disclosed. The fastener system uses a combination of materials to form elements that can be adapted to different fastening applications. A first component of the system includes two members. The first member has an aperture for accommodating a T-shaped attachment member and a button. The second member has a T-shaped attachment member that fits through the aperture and rotates sideways to prevent passing backward through the aperture. The second member also has a strap for securing the attachment member against the aperture by attaching the strap to the button. A second component of the system includes a button with an enlarged head and base, and a flexible washer that fits over the head of the button. Fabric of an article to be secured may be laid over the head of the button and secured around the head of the button using the washer.

20 Claims, 26 Drawing Sheets

(56) References Cited

U.S. PATENT DOCUMENTS 2,838,821 A * 6/1958 Shur ..... F16B 21/073 24/662
2,901,796 A * 9/1959 Hope ..... A44B 1/34 24/711.4
2,933,793 A * 4/1960 Steinberg ..... A44B 17/007 24/622
3,210,820 A * 10/1965 Humiston ..... F16B 21/06 D11/220
3,213,507 A * 10/1965 Leonard ..... F16B 5/065 24/682.1
3,416,200 A * 12/1968 Daddona, Jr. ..... A44B 17/0029 24/DIG. 43
3,729,780 A * 5/1973 White ..... G09F 3/00 24/543
4,470,174 A 9/1984 Rhea
4,962,573 A * 10/1990 Breveglieri ..... A44B 17/0029 24/324
5,940,942 A * 8/1999 Fong ..... A44B 1/34 24/72.5
6,058,576 A * 5/2000 Harris ..... A44C 5/2057 24/616
7,013,497 B1 * 3/2006 Grant ..... A44B 11/28 2/459
8,782,814 B2 * 7/2014 Schmelzer ..... A44B 1/32 63/23
10,016,021 B2 * 7/2018 Drage ..... A44C 3/001
2012/0185996 A1 7/2012 Goldberg et al.
2017/0156450 A1 * 6/2017 Hutsenpiller ..... A44B 17/0047

OTHER PUBLICATIONS

International Application Serial No. PCT/CA2021/050216, International Search Report mailed Apr. 28, 2021, 5 pgs.
International Application Serial No. PCT/CA2021/050216, Written Opinion mailed Apr. 28, 2021, 8 pgs.

* cited by examiner

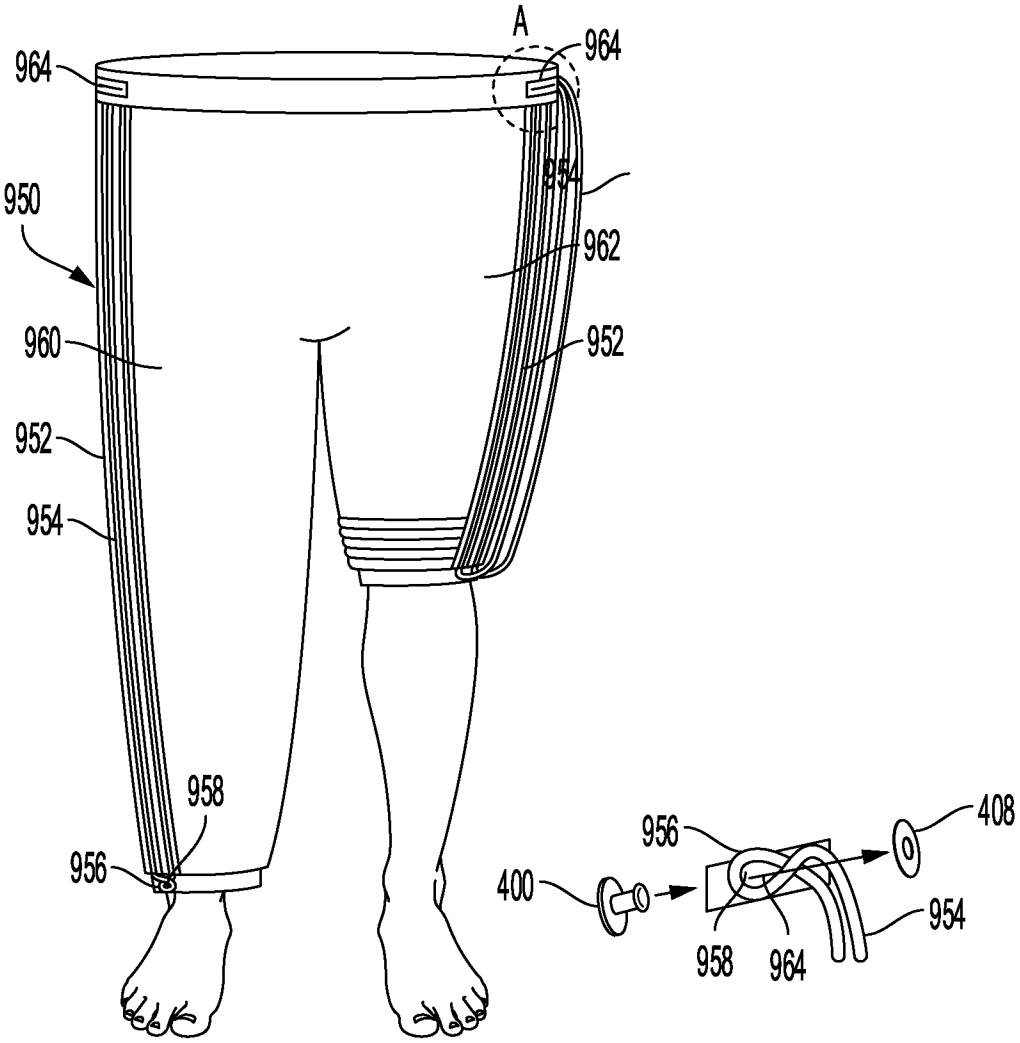
FIG. 10B
FIG. 10C
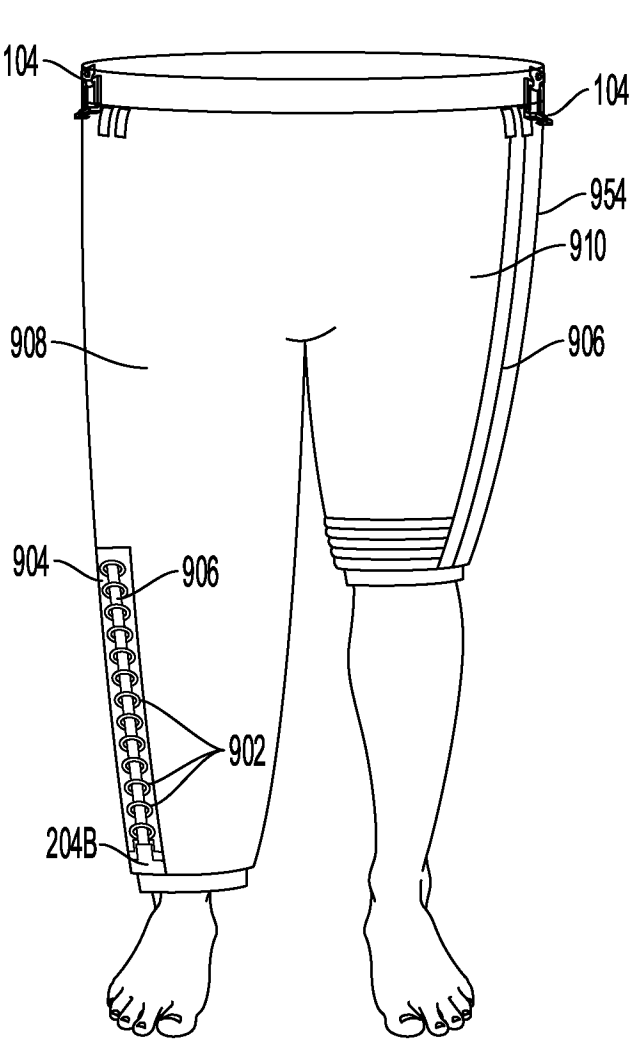
FIG. 10A

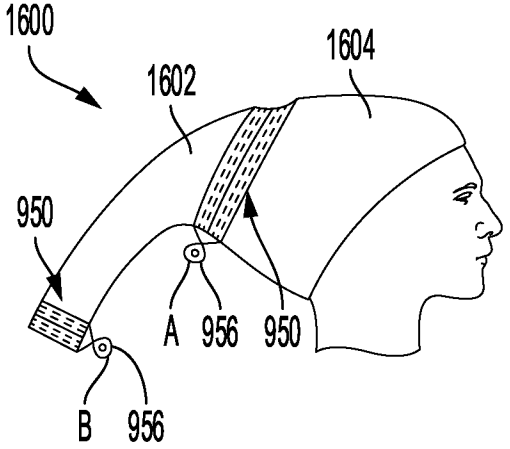
FIG. 16A
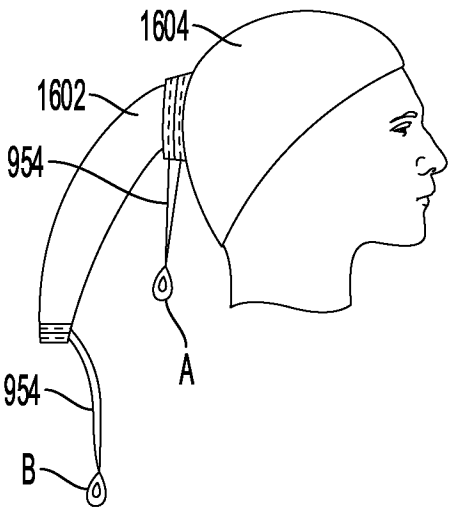
FIG. 16B
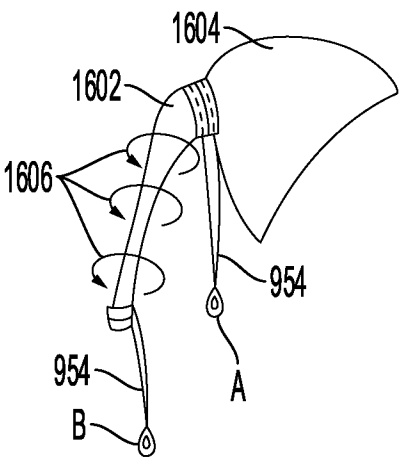
FIG. 16C
FIG. 16D
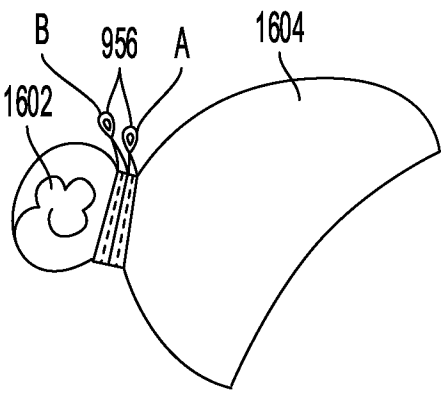
FIG. 16E
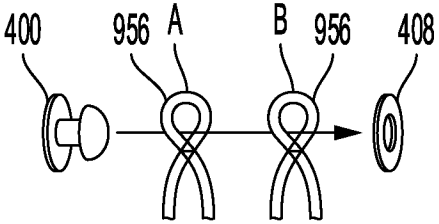
FIG. 16F

FASTENER SYSTEMS, METHODS, AND ARTICLES

RELATED APPLICATIONS

The present application claims priority to U.S. Provisional Patent Application No. 62/980,985, filed Feb. 24, 2020, the entire contents of which are incorporated herein by reference.

FIELD OF THE INVENTION

At least one embodiment of the present invention pertains to fastener systems, and more particularly, to fastener systems, methods, and articles having an attachment receiving member having a passage.

BACKGROUND

Existing fastener systems can be complicated to use and require a user to perform multiple steps in order to achieve the desired effect. Existing fastener systems can have effectiveness limited to a small number of existing environments, or designs precluding multi-application use. Fastener systems may also be single use, environmentally unfriendly, allergenic, and/or unwashable, precluding use in specific applications.

Fasteners used as part of existing products have a tendency to break or lose pieces before the rest of the product wears out: buttons may detach and be lost, and zippers, clasps, and buckles may malfunction, thereby rendering the entire product unusable and leading to users discarding the entire product rather than repair the faulty part, which may be impossible or may incur a greater cost in time and/or money than replacing the article. This leads to unnecessary waste, inefficiency, and long-term expense.

Another factor leading to unnecessary replacement of existing articles is the desire for new or updated aesthetics. Existing articles may be usable but may not reflect the user's current aesthetic preferences, and so they may be discarded and replaced. As fasteners are often a conspicuous visual element of an article's overall aesthetic style, the outdated aesthetic style of a fastener often contributes to this desire to replace a still-usable article.

There thus exists a need for fasteners that address one or more of the shortcomings of existing fasteners for clothing, personal accessories, household items, or other items.

SUMMARY

This summary is provided to introduce in a simplified form certain concepts that are further described in the Detailed Description below and the drawings. This summary is not intended to identify so called "essential" features of the claimed subject matter or to limit the scope of the claimed subject matter.

Fastener systems, components thereof, methods of use thereof, and articles configured for interoperability thereof are described herein. In various embodiments, the fastener systems and their components may present various advantages. The components of the system may be small and modular, facilitating easy replacement in case of breakage or loss, washability, replacement to update aesthetic preferences, environmental friendliness, and interoperability of a collection of garments or other articles using the fastener system. For example, the fasteners described herein may be stockpiled by institutions for use with uniforms worn by staff, temporary clothing worn by patients (e.g. hospital gowns), or protective clothing worn by staff or students (e.g. smocks for a child care center or an assisted living facility), and a central laundry and inventory system may be used to track, replace, wash, and manage the various components of the system without the need to replace entire articles of clothing or other articles secured by the fasteners. By allowing individual fasteners to be swapped in and out, replaced, and washed individually, the reusability and availability of a given article secured by the fasteners may be improved. Garments or other artiest with built-in fasteners typically need to be replaced or repaired if the fastener is lost or broken; however, the modular fastener systems described herein enable replacement, repair or washing of individual fastener components without affecting the use of the article itself. This may reduce waste, including hospital waste. It may also enable significant cost savings in underserved communities and countries.

In a first aspect, a fastener system is disclosed. The fastener system comprises a first member and a second member. The first member comprises a first part attached to a first attachment-receiving member, and a second attachment-receiving member. The first attachment-receiving member has a passage. The second member comprises an attachment member, a second part attached to the attachment member, and a third part attached to the attachment member. The passage permits the attachment member in a first orientation to pass, and prevents the attachment member in a second orientation from passing. The third part is capable of fastening to the second attachment-receiving member to secure the attachment member in the second orientation.

In a second aspect, the attachment member is t-shaped.

In a further aspect, the first attachment-receiving member further comprises a groove capable of receiving the attachment member.

In a further aspect, the first part, the second part, the first attachment-receiving member and the attachment member are washable.

In a further aspect, the first part, the second part, the first attachment receiving member and the attachment member comprise non-synthetic materials.

In a further aspect, the second part further comprises an attachment region distal from the first attachment-receiving member adapted to attach to a further article.

In a further aspect, the first part further comprises an attachment region distal from the attachment member adapted to attach to a further article.

In a further aspect, the fastener system further comprises a wearable article connected at a first end to a first end of the second part distal from the attachment-receiving member, and connected at a second end to a first end of the second part distal from the attachment member.

In a further aspect, the wearable article is an article of clothing.

In a further aspect, the wearable article is an accessory.

In a further aspect, the wearable article is wearable equipment.

In a further aspect, the second attachment-receiving member protrudes from the attachment receiving member and comprises a head portion distal from the attachment receiving member and a neck portion, the head portion having a larger cross sectional area compared to the neck portion In a second embodiment, a fastener system is disclosed comprising a first fastening member and a second fastening member. The first fastening member comprises a first fastening part having a first end and a second end and a second fastening part connected to the second end. The second fastening member is adapted to secure a first article by passing over at least the first article and the second fastening part and achieving an interference fit with the first fastening part.

In a further aspect, the second fastening part has a cross sectional area larger than the second end.

In a further aspect, the second fastening member comprises a non-synthetic material.

In a further aspect, the second fastening member is an o-ring and the second fastening part is circular.

In a further aspect, the first article is a scarf.

In a further aspect, the first article is a hijab.

In a third embodiment, a kit is disclosed comprising the fastener system of the first embodiment and the fastener system of the second embodiment.

By providing a system or kit of multi-use fastener components manufactured from washable materials, the present disclosure may provide users with multiple options for securing various personal articles. Individual components of the kit may be provided in a variety or colours, style, sizes, and/or shapes, for use in different applications or in coordination with various different outfits, or for use with changing aesthetic preferences over time. Individual components of the kit may be washed while other components are in use. Individual components of the kit can be replaced or repaired if damaged or lost while other components, and the articles with which the component are used, are in use. Other potential advantages of various embodiments will be apparent to the skilled reader.

Other aspects of the system will be apparent from the accompanying figures and detailed description. Further example embodiments of the claimed subject matter will be appreciated from the following detailed description and drawings.

BRIEF DESCRIPTION OF THE DRAWINGS

FIG. 10A is a front view of a pair of pants having pants legs fitted with the first example sleeve rolling fastener system of FIG. 9A.

FIG. 10B is a front view of a pair of pants having pants legs fitted with the second example sleeve rolling fastener system of FIG. 9B.

FIG. 10C is a front left side detail view of region "A" of FIG. 10B showing a loop being secured with a first fastening member and second fastening member of FIG. 4A.

FIG. 16A is a right side view of a head wrap configured to use the fastener system of FIG. 4A and the second example sleeve rolling fastener system of FIG. 9B for securing the head wrap to a user's body, showing a first step in a method of securing the head wrap.

FIG. 16B is a right side view of the head wrap of FIG. 16A, showing a second step in the method of securing the head wrap.

FIG. 16C is a right side view of the head wrap of FIG. 16A, showing a third step in the method of securing the head wrap.

FIG. 16D is a right side view of the head wrap of FIG. 16A, showing a fourth step in the method of securing the head wrap.

FIG. 16E is a right side view of the head wrap of FIG. 16A, showing a fifth step in the method of securing the head wrap.

FIG. 16F is a detail view of the fastener system of FIG. 4A being used to secure the head wrap of FIG. 16A in a sixth step in the method of securing the head wrap.

DETAILED DESCRIPTION

The making and using of the presently described embodiments are discussed in detail below. The specific embodiments discussed are merely illustrative of specific ways to make and use the invention, and do not limit the scope of the invention.

References in this description to "an embodiment", "one embodiment", or the like, mean that the particular feature, function, structure or characteristic being described is included in at least one embodiment of the present invention. Occurrences of such phrases in this specification do not necessarily all refer to the same embodiment. On the other hand, such references are not necessarily mutually exclusive either.

Disclosed herein are fastener systems, methods of using the fastener systems, and articles incorporating components of the fastener systems.

The disclosed fastener system, in a first example embodiment, comprises (1) a first attachment-receiving member, connected to a first part and having a second attachment receiving member, and (2) an attachment member, connected to a second part and a third part. The first attachment-receiving member includes a passage. Various components and use cases of the first example fastener system are shown in FIGS. 1 through 3C, 5A through 8C, 12, and 20A-B.

In a first configuration, the attachment member is permitted to pass through the passage. In a second configuration, the attachment member is prevented from passing through the passage.

The third part fastens to the second attachment-receiving member, securing the attachment member in the second configuration and thereby precluding the attachment member from passing through the passage.

Figure 1:
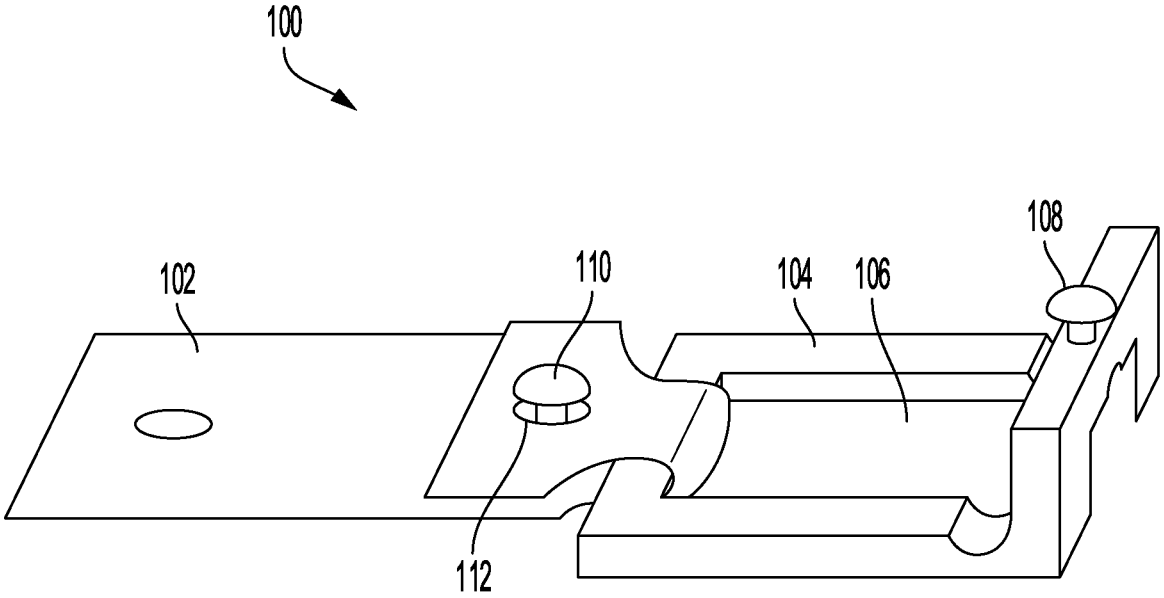
FIG. 1 is a perspective top left side view of a first member of an example fastener system in accordance with the present disclosure.

Referring to FIG. 1, a first member 100 according to a first example embodiment of the present disclosure is shown. The first member 100 consists of a first part 102 attached to a first attachment-receiving member 104. The first attachment-receiving member 104 has a passage 106 and a second attachment-receiving member 108. In the example embodiment shown, the second attachment-receiving member 108 is a button.

In the example embodiment shown, the first part 102 contains a first region having a first attachment passage 112 and a second attachment passage (not shown) used to attach the first part 102 to the first attachment-receiving member 104. The first part 102 is folded over so that the first attachment passage 112 overlaps the second attachment passage. A third attachment-receiving member 110, shown in the example embodiment as a button, has a head portion that passes through the second attachment passage and the first attachment passage 112 in a configuration wherein the first part 102 is wrapped around the first attachment receiving member 104 such that the first attachment passage 112 and a second attachment passage (not shown), when attached to the third attachment-receiving member 110, attach the first part 102 to the first attachment-receiving member 104.

In example embodiments, the first part 102 may be attached to the first attachment-receiving member 104 via sewing, gluing, or other attachment means known to a person skilled in the art, either as an alternative to, or in addition to, the engagement described above using the third attachment-receiving member 110.

Figure 2C:
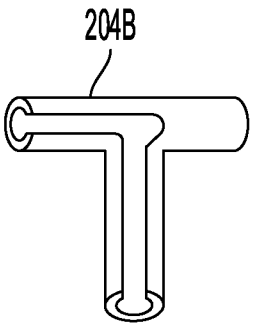
FIG. 2C is a top view of a second attachment member element of the second member of FIG. 2A.
Figure 2B:
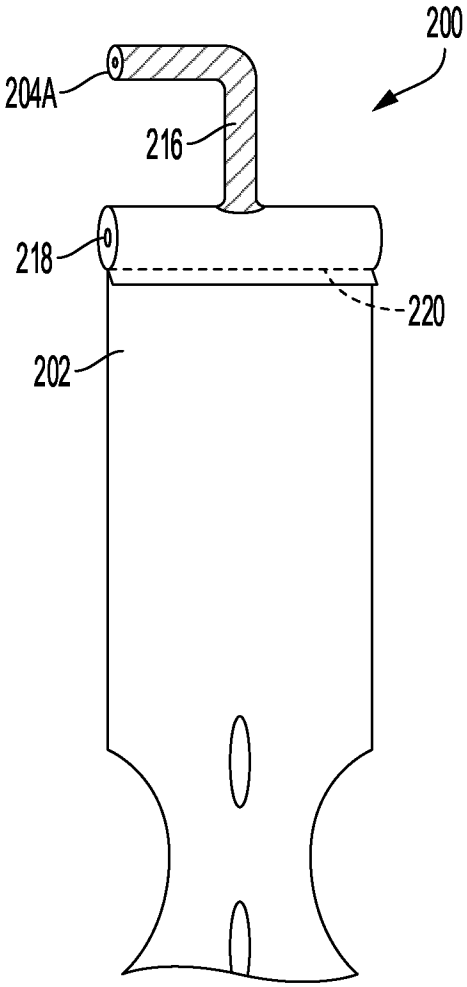
FIG. 2B is a second partially disassembled top view of the second member of FIG. 2A.
Figure 2A:
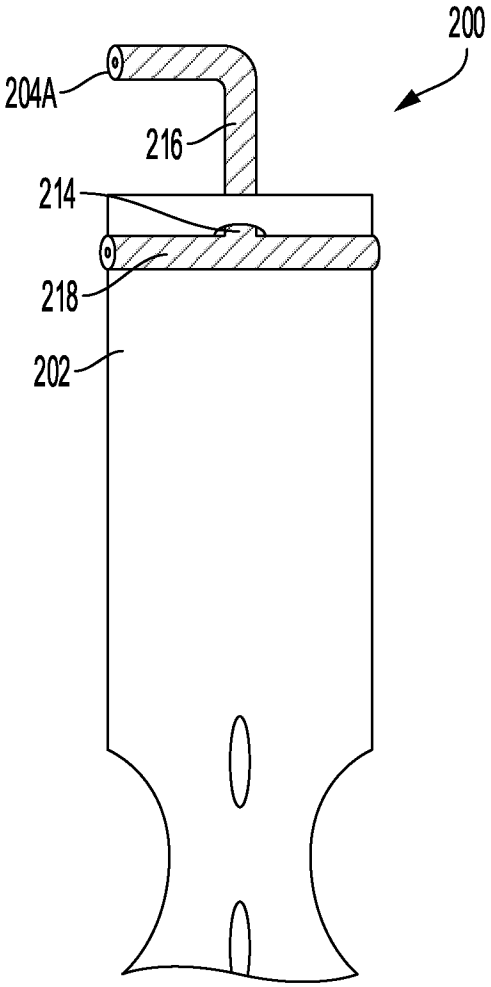
FIG. 2A is a partially disassembled top view of a second member of the fastener system of the first member of FIG. 1.

Example elements which may form a second member 200 of the fastener system are shown in FIG. 2A to 2C. The second member 200 may comprise a second part 202, and an attachment member resulting from a first attachment member element 204A, and a second attachment member element 204B. In the example embodiment shown, the second part 202 comprises a passage 214 through which at least part of the first attachment member element 204A passes through.

In the shown embodiment, the first attachment member element 204A (shown striped) consists of an L-shaped region 216 which is passed through the passage 214 of the second part 202, and a second region 218 which prevents further passage of the first attachment member element 204A through the passage 214. The first attachment member element 204A may vary in shape, geometry, width, material, and so forth. For example, the second region 218 of the first attachment member element 204A may comprise an L-shaped region as in the shown embodiment.

The first attachment member element 204A is attached to the second part 202. In example embodiments, the first attachment member element 204A is attached to the second part 202 by folding a region of the second part 202 over the second region of the first attachment member element 204A and securing the region of the second part 202 to the remainder of the second part 202, as shown in FIG. 2B. In example embodiments, the second part 202 may be attached to the first attachment member element 204A via sewing, gluing, or other attachment means known to a person skilled in the art, either as an alternative to, or in addition to, the engagement of the second region 218 with the second part 202 by passing through the passage 214. In the shown embodiment, a stitched seam 220 is shown securing the fabric of the second part 202 around the t-shaped second region 218 of the first attachment member element 204A.

FIG. 2C is a diagram of a second attachment member element 204B. The second attachment member element 204B in the shown example embodiment is integrated with the first attachment member element 204A to form the attachment member 204 in example embodiments. The second attachment member element 204B, similar to the first attachment member 204A, may vary in shape, geometry, width, material, and so forth, in unison with the first attachment member 204A. For example, the second attachment member element 204B may be a t-shaped element, as in the shown embodiment, in order to integrate with the first attachment member 204A.

The second attachment member element 204B may be attached to the first attachment member element 204A via sewing, gluing, or other attachment means known to a person skilled in the art. In various embodiments, the first attachment member element 204A may be formed from a deformable material such as fabric, metal wire, or metal wire coated in silicone, thereby allowing it to be compressed and inserted into the interior passage of the second attachment member element 204B to effect a friction or interference fit.

Figure 2E:
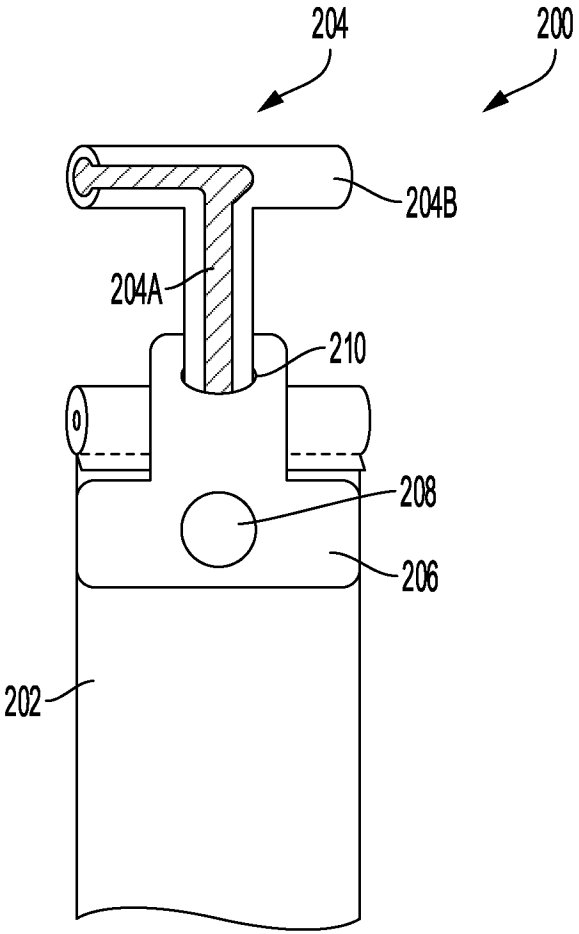
FIG. 2E is an assembled bottom view of the second member of FIG. 2A including the third part.
Figure 2D:
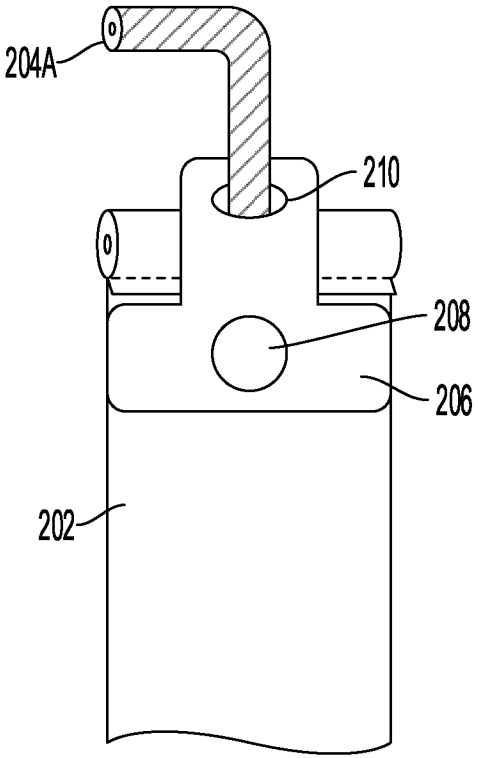
FIG. 2D is a third partially disassembled top view of the second member of FIG. 2A and a third part.

The attachment member may further be attached to a third part. Referring now to FIGS. 2D and 2E, a diagram pertaining to an example embodiment showing the assembly of the third part 206 and attachment member 204 is shown. The third part 206 is attached to the first attachment member 204A, which in the shown embodiment comprises a third part passage 210 through which the L-shaped region of the first attachment member element 204A has passed through. With the third part 206 attached to the first attachment member element 204A, the second attachment member element 204B is integrated with the first attachment member element 204A.

The third part 206 may further comprise a means for attaching to the second attachment-receiving member 108. In the example embodiment shown in FIG. 2E, the means for attaching to the second attachment member 108 include a passage 208. It will be appreciated that the third part 206 may be unnecessary in some examples: for example, if there is sufficient tension in a connection such that the t-shaped attachment member 204 is held tight against the securing buckle (first attachment-receiving member 104), the third part 206 may be omitted.

Figure 3A:
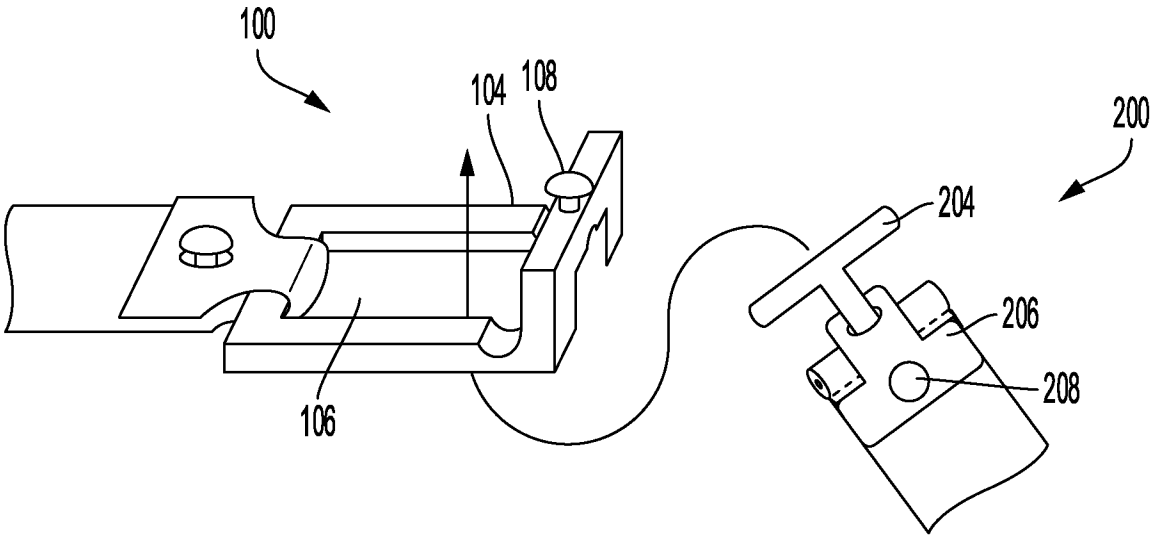
FIG. 3A is a perspective top left side view of the first member of FIG. 1 and second member of FIG. 2E, decoupled from each other.
Figure 3C:
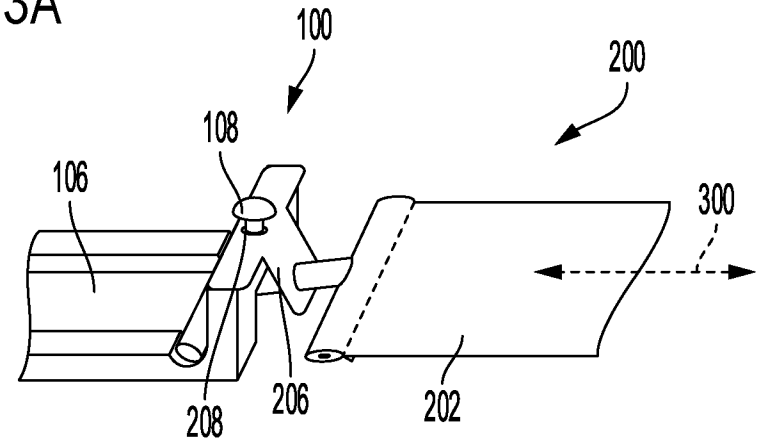
FIG. 3C is a perspective top left side partial detail view of the first member of FIG. 1 and second member of FIG. 2E, coupled to each other and secured using the third part.
Figure 3B:
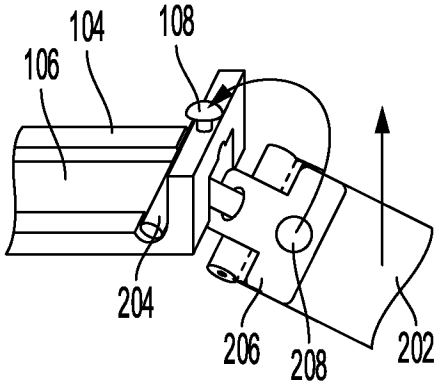
FIG. 3B is a perspective top left side partial detail view of the first member of FIG. 1 and second member of FIG. 2E, coupled to each other.

Referring now to FIGS. 3A-3C, a diagram of the first member 100 and second member 200 interacting is shown according to an example embodiment. The passage 106 is capable of permitting the attachment member 204, when in a first orientation, to pass through. In the shown embodiment, the attachment member 204 is t-shaped, and the first attachment-receiving member 104 includes a passage 106 having a rectilinear shape, with the first orientation comprising the attachment member 204 being turned to have the prongs of the t-shaped region perpendicular to a plane coplanar to the rectangular passage 106. In example embodiments, the passage 106 can be any shape, size or geometry capable of permitting passage to an attachment member 204.

Similarly, the attachment member can be any shape, size or geometry capable of passing through the passage 106.

In FIG. 3B, the attachment member 204 is shown in a second configuration in accordance with example embodiments of the present disclosure. The attachment member 204 in the second configuration is prevented from passing through the passage 106. In the shown embodiment, the t-shaped attachment member 204 in a second configuration is too wide to pass through the passage 106.

The third part 206 is fastened to the second attachment-receiving member 108 in order to further secure the fastener. In the shown embodiment, the third part 206 comprises the passage 208, which deforms such that the second attachment-receiving member 108 is capable of passing through. In example embodiments, the second attachment-receiving member 108 is a button with a head portion and a neck portion, and the third part 206 is deformable and capable of passing over the head of the button second attachment-receiving member 108, and achieving an interference fit with the neck region of the button second attachment-receiving member 108.

In example embodiments, the second attachment-receiving member 108 can be any shape, size or geometry capable of passing through the passage 208. In example embodiments, the passage 208 can be any shape, size or geometry capable of passing through the second attachment-receiving member 108. For example, the passage 206 and the second attachment-receiving member 108 can be rectangular. FIG. 3C shows an example embodiment wherein the third part 206 is fastened to the second attachment-receiving member 108 via the passage 208, whereby relative axial motion along the axis 300 of the first member 100 and the second member 200 is prevented or decreased.

Figure 4B:
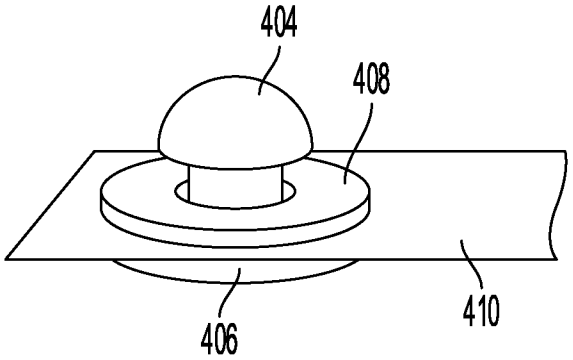
FIG. 4B is a perspective top left side view of the first fastening member and second fastening member of FIG. 4A fastened to an article.
Figure 4A:
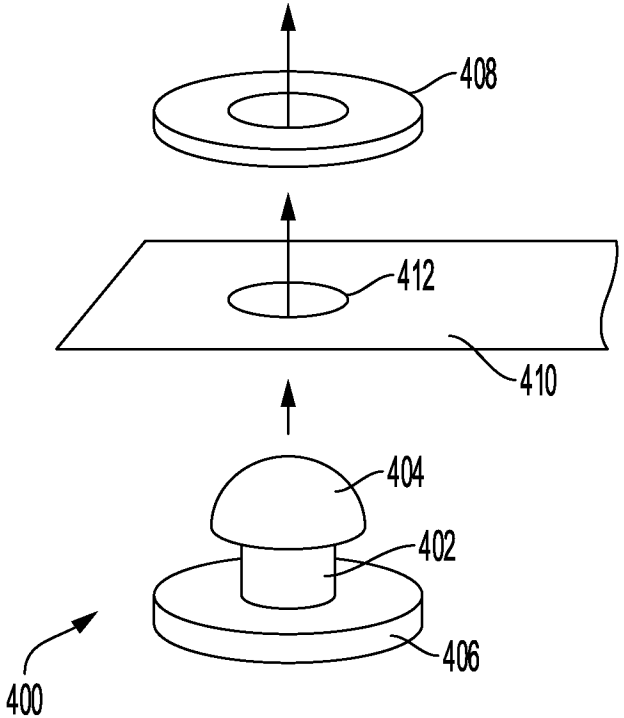
FIG. 4A is a perspective top left side exploded view of a first fastening member and second fastening member of an example fastener system in accordance with the present disclosure.

Referring now to FIG. 4A, a second example embodiment of a fastening system in accordance with the present disclosure is shown.

A first fastening member 400 may comprise a first fastening part 402 and a second fastening part 404. The first fastening part 402 may have a first end and a second end, and the second end of the first fastening part 402 is connected to the second fastening part 404. In the embodiment shown, the first fastening part 402 is connected to a third fastening part 406. The first fastening member 400 may be referred to herein as a "stud"; the second fastening part 404 may be referred to herein as a "head" or "head portion" thereof; the first fastening part 402 may be referred to herein as a "neck" or "neck portion" thereof; and the third fastening part 406 may be referred to herein as a "base" or "base portion" thereof. It will be appreciated that the illustrated embodiments show the button 400 as being identical to the third attachment-receiving member 110 of FIG. 1, which may also be referred to as a "button".

The second fastening part 404 has at least a first region. In the example embodiment shown, the first region of the second fastening part 404 is button shaped, having a varying cross sectional area in a first axis. In example embodiments, the first region has a varying geometry, size, shape and so forth. For example, the first region may have a cross sectional area that varies in shape but not size.

Figure 4C:
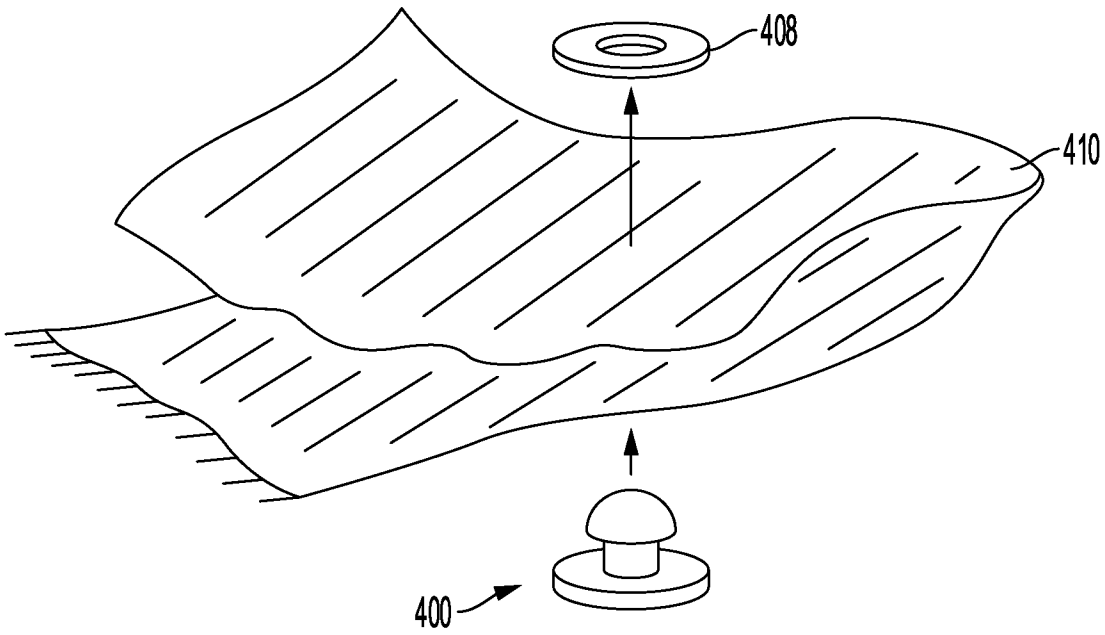
FIG. 4C is a perspective top left side exploded view of the first fastening member and second fastening member of FIG. 4A fastened to an article having no hole defined in it.
Figure 5A:
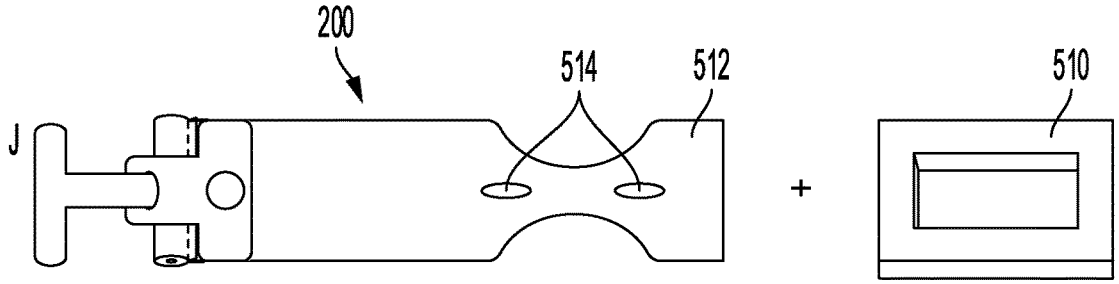
FIG. 5A is a top view of the second member of FIG. 2E showing a distal end of the second member detached from a buckle.
Figure 5B:
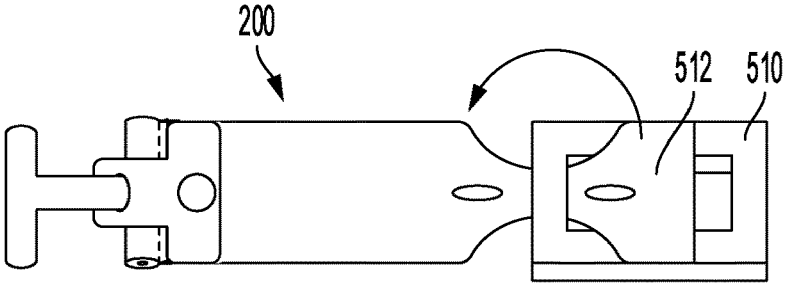
FIG. 5B is a top view of the second member of FIG. 2E showing the distal end of the second member partially attached to the buckle.
Figure 5C:
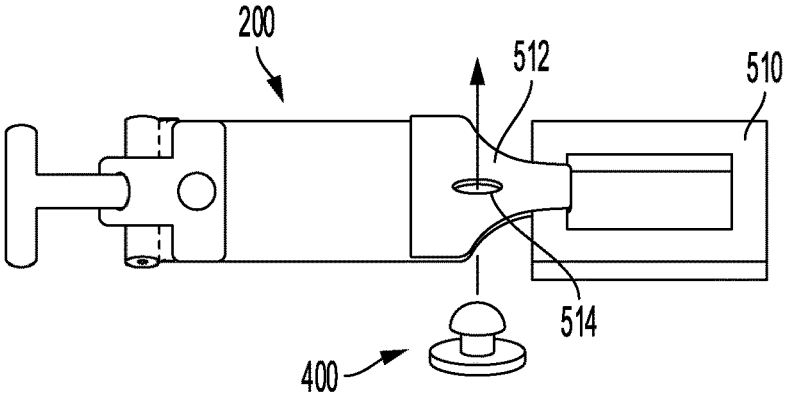
FIG. 5C is a top view of the second member of FIG. 2E showing a distal end of the second member partially attached to the buckle.
Figure 5D:
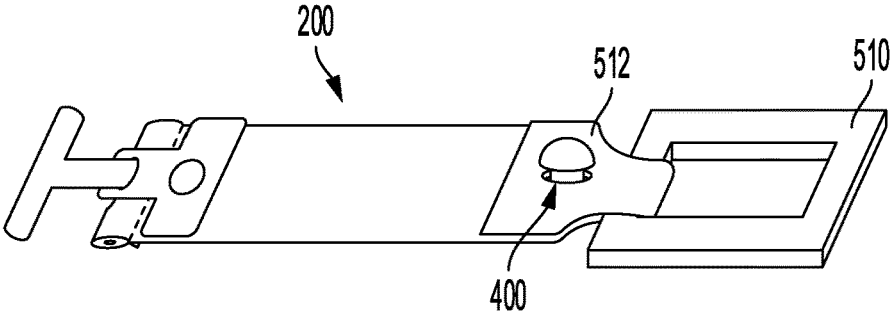
FIG. 5D is a top view of the second member of FIG. 2E showing a distal end of the second member fully attached to the buckle.

FIG. 4A shows the first fastening member 400 with its head 404 and neck 402 passing through a first article passage 412 (such as a buttonhole) in a first article 410, such as a piece of clothing or other fabric article. A second fastening member 408 is adapted to secure the first fastening member 400 to the first article 410 by passing over the head 404 of the first fastening member 400 and achieving an interference fit with the neck 402 thereof, as shown in FIG. 4B. FIG. 4C shows a different configuration, in which the second fastening member 408 is adapted to secure the first article 410 by passing over at least the first article 410 and the first region of the second fastening part 404 and achieving an interference fit with the first fastening part 402. The second fastening member 408 may be referred to herein as a "washer".

In some example embodiments, as shown in FIG. 4A-4B, the first article 410 defines a first article passage 412, permitting the first article 410 to be secured to the first fastening member 400 via passing the first article passage 412 over the second fastening part 404. Securing the first article 410 to the first fastening member 400 via passing the first article passage 412 over the second fastening part 404 may allow for less distortion of the first article 410 than would occur in the absence of the first article passage 412, as shown in FIG. 4C.

As shown in FIG. 4C, the first fastening member 400 and second fastening member 408 may be used to secure a first article 410 that does not have a passage 412. The article 410, shown here as a piece of fabric folded over into two layers, may lie on top of the first fastening member 400 and be pressed down and around the first fastening member 400 by pushing the second fastening member 408 down onto and around the bottom of the second fastening part 404. This technique may be used in place of a pin or brooch to secure fabric articles without making holes in them. It will be appreciated that, in some examples, the washer 408 may be unnecessary to secure the button 400 in place, and the button 400 may be used without the additional reinforcement of the washer 408 to hold it in place, e.g. within a buttonhole such as article passage 412.

It will be appreciated that the first example fastener system of FIGS. 1-3C and the second example fastener system of FIGS. 4A-4C may contain components in common, such as first fastening member 400 (which may be identical to the third attachment-receiving member 110), and may be combined as a single fastener system in order to realize one or more of the advantages described above, such as ease of replacement, ease of updating aesthetic preferences, reusability, and versatility. Additional applications of the example fastener systems and their various components will now be described.

FIGS. 5A-5D show the second member 200 having a distal end 512 being attached to a further article, shown here as a buckle 510. The distal end 512 has two apertures 514. The distal end 512 is wrapped around a portion of the buckle 510 and secured in place with the first fastening member 400 (or another button-like fastening member such as third attachment-receiving member 110) passing through the overlapped apertures 514. The buckle 510 may in turn be secured to another item.

Figure 6:
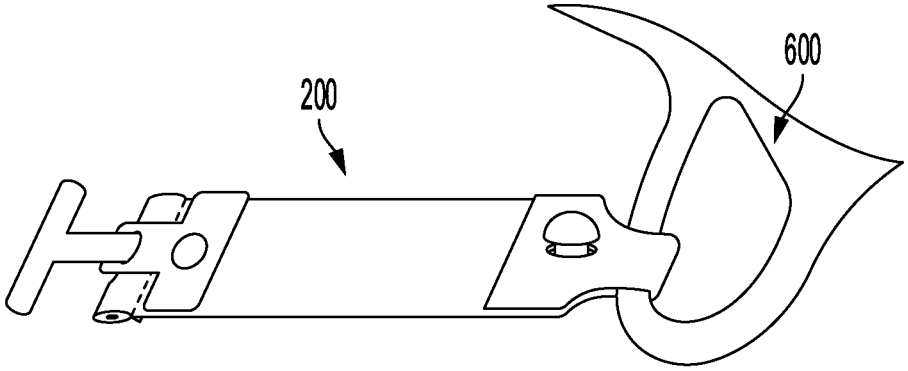
FIG. 6 is a perspective top left side view of the second member of FIG. 2E showing a distal end of the second member attached to a helmet.

FIG. 6 shows the second member 200 having its distal end 512 secured to a strap of a helmet 600 using the same attachment technique shown in FIGS. 5A-5D.

Figure 7A:
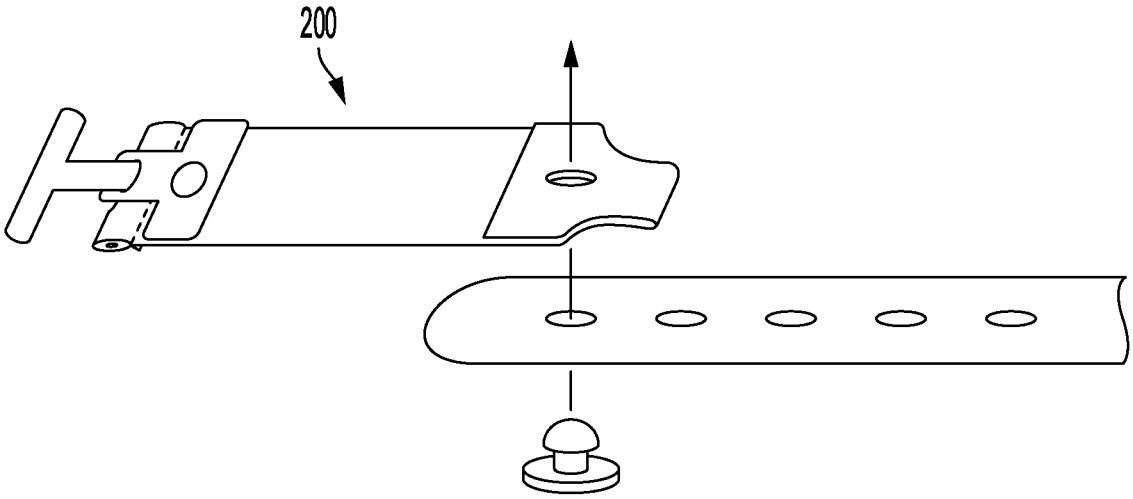
FIG. 7A is a perspective top left side view of the second member of FIG. 2E showing a distal end of the second member secured to a belt using the first fastening member.

FIG. 7A shows the second member 200 with its distal end 512 secured to a belt 700 using the first fastening member 400. The first fastening member 400 passes through a belt notch and through the overlapped apertures 514.

Figure 7B:
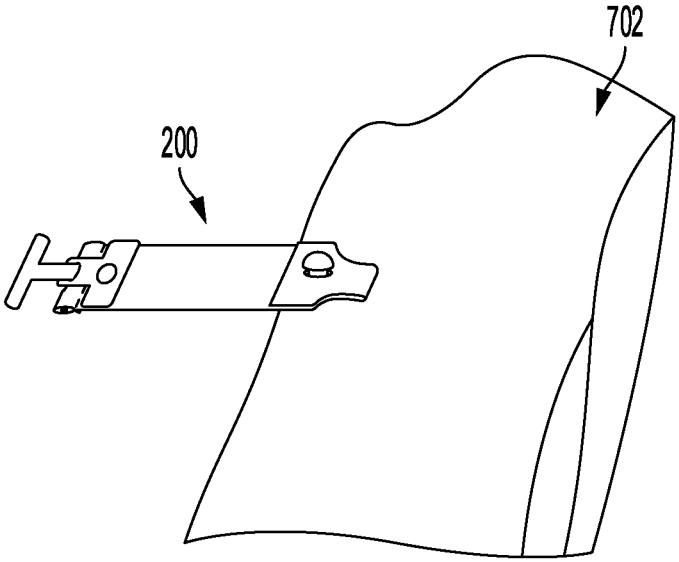
FIG. 7B is a perspective top left side view of the second member of FIG. 2E showing a distal end of the second member attached to clothing using the first fastening member.

FIG. 7B shows the second member 200 with its distal end 512 secured to an article of clothing 702 using the first fastening member 400. The first fastening member 400 may pass through a buttonhole of the clothing 702 or may secure the clothing 702 without making a hole as shown in FIG. 4C. The first fastening member 400 then passes through the overlapped apertures 514.

Figure 8A:
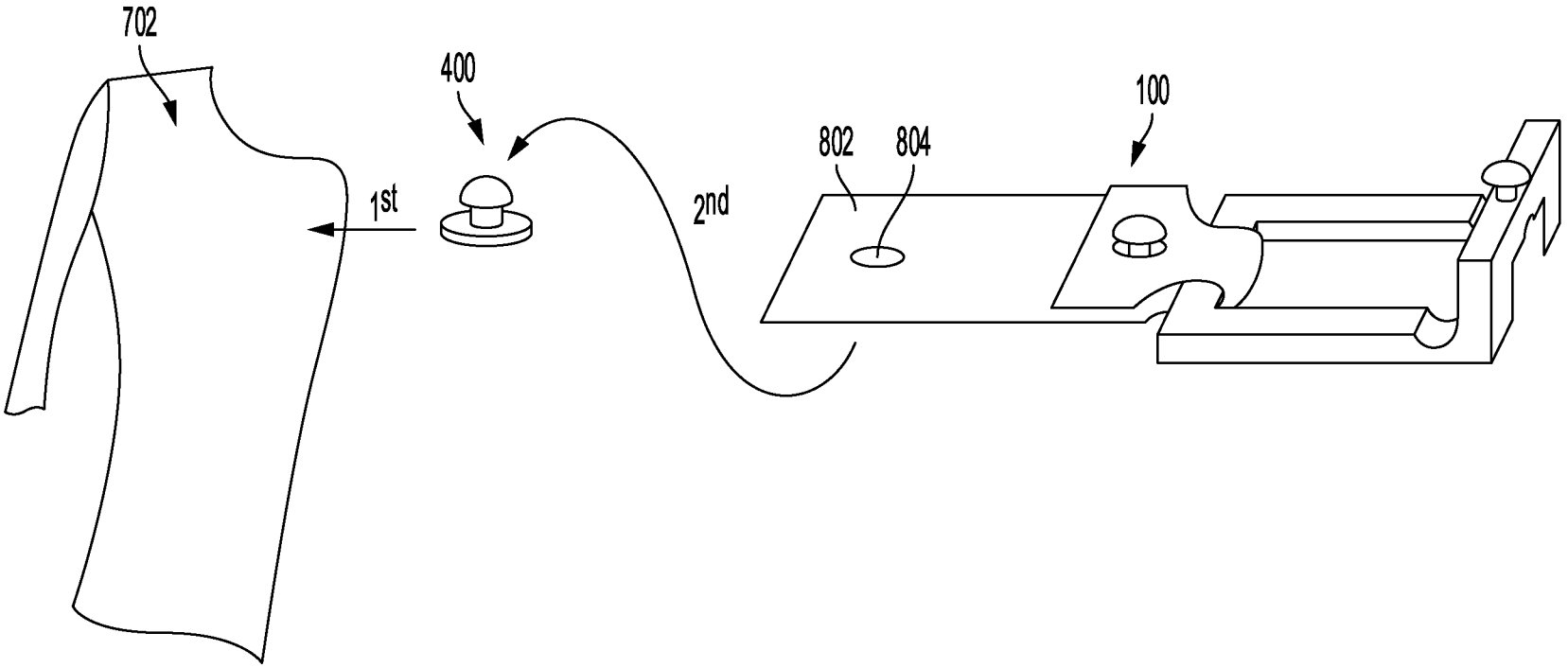
FIG. 8A is a perspective top left side view of the first member of FIG. 1 showing a distal end of the first member secured to clothing using the first fastening member.
Figure 8C:
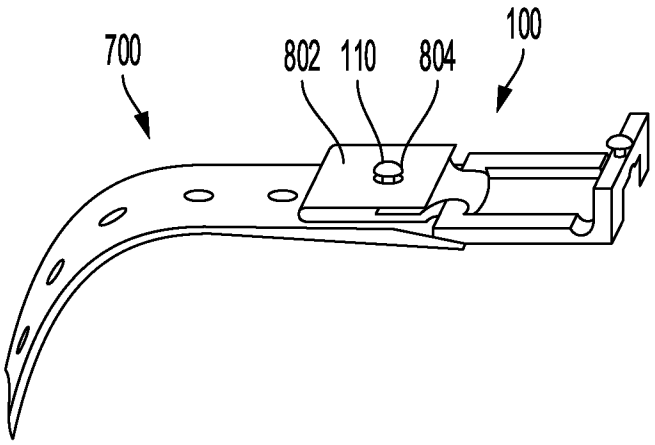
FIG. 8C is a perspective top left side view of the first member of FIG. 1 showing a distal end of the first member secured to a belt using the third attachment-receiving member.
Figure 8B:
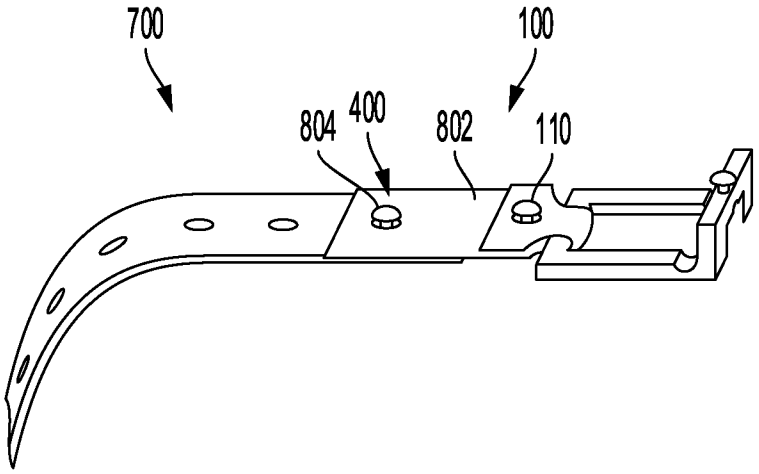
FIG. 8B is a perspective top left side view of the first member of FIG. 1 showing a distal end of the first member secured to a belt using the first fastening member.

FIG. 8A shows the first member 100 having a distal end 802 secured to clothing 702 using the first fastening member 400, with the first fastening member 400 being secured to the clothing 702 by passing through a buttonhole (not shown) in the clothing 702, via gluing, or via another attachment means such as sewing. Alternatively, the first fastening member 400 may pass through a buttonhole of the clothing 702 or secure it without making a hole as shown in FIG. 4C. The first fastening member 400 then passes through an aperture 804 of the distal end 802. By securing one or more first members 100 to one side of an article of clothing 702 and one or more second members 200 to another side of the article of clothing 702, the fastener system may be used to fasten the two sides of the article of clothing 702 together, e.g. in place of buttons, straps, snaps, hook and loop fasteners, or zippers. FIGS. 8B and 8C show two alternative techniques for the first member 100 at its distal end 802 to a belt 700. In FIG. 8B, the distal end 802 is secured by passing the first fastening member 400 through a belt notch and an aperture in the distal end 802. In FIG. 8C, the distal end 802 is secured by passing the third attachment-receiving member 110 through a belt notch and through an overlap of the distal end aperture 804 with the passage 112.

Figure 9A:
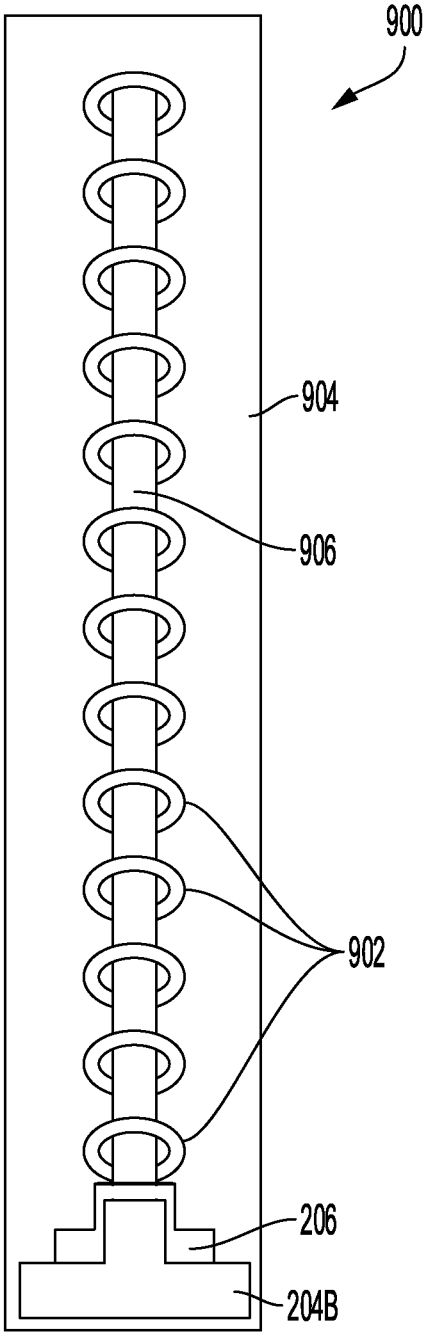
FIG. 9A is a side view of a first example sleeve rolling fastener system in accordance with the present disclosure.

A first example sleeve rolling fastener system 900 and second example sleeve rolling fastener system 950 are now described with reference to FIGS. 9A-12. The sleeve rolling fastener systems 900, 950 are configured to assist in securing a rolled shirt sleeve or pant leg in a rolled-up position, or for securing other articles as described below with reference to FIGS. 16A-F and 17A-B. Sleeves, pant legs, or other fabric articles may be rolled up for various purposes, including comfort in changing weather or changing environment, to facilitate movement, for hygiene (e.g. in a medical environment), to facilitate handwashing, or to protect clothing from being soiled. As shown in FIG. 9A, the first example sleeve rolling system 900 includes a flexible strip 904 to which are affixed a plurality of washers 902. (It will be appreciated that washer 902 may be different in design from washer 408: for example, washer 902 may be a thin metal ring that is circular in cross section, whereas washer 408 may be a wider, flatter flexible ring that is rectangular or ovoid in cross-section.) Each washer 902 may be attached to the flexible strip 904 at a single point about its circumference, for example by passing through a pair of apertures (not shown) in the flexible strip 904 or by being sewn or bonded to the flexible strip 904. The washers 902 are arranged in a vertical line, with a vertical longitudinal passage being defined by their centres. A cord 906, such as a braided cotton pullstring or drawstring, passes through the longitudinal passage defined by the washers 902. At a bottom end, the cord 906 passes through a flexible securing strap (shown here as third part 206) and is then attached to a rigid T-piece shown here as identical to the second attachment member element 204B. A top end of the cord 906 (not shown) may be secured to the flexible strip 904, for example by being sewn or bonded. The flexible strip 906, and any of the fabric or other flexible surface to which it is attached (e.g. by sewing), may be gathered, bunched, or telescoped into a shorter configuration and held in said configuration thereby.

Figure 9B:
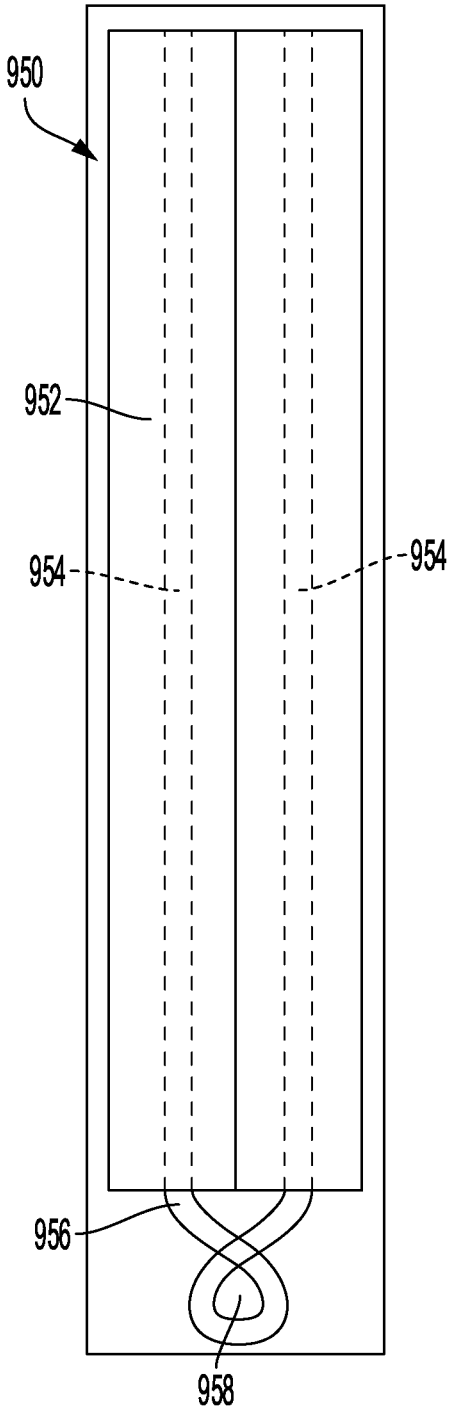
FIG. 9B is a side view of a second example sleeve rolling fastener system in accordance with the present disclosure.

FIG. 9B shows the second example sleeve rolling fastener system 950. A drawstring 954 passes through two parallel passages in a strip of fabric 952. The drawstring 954 emerges from the parallel passages at the bottom end of the strip of fabric 952 to form a loop 956 defining an aperture 958. The drawstring 954 may be formed from a somewhat elastic, flexible material to enable the passage of the enlarged head 404 of a first fastening member 400 to pass through the aperture 958 and close the loop 958 tight about the neck portion 402 of the first fastening member 400. In use, the loop 956 of the drawstring 954 may be pulled to shorten and bunch the fabric strip 952 along the length of the vertical parallel passages; the loop 956 may then be secured to another component to secure the fabric strip 952 in a shortened configuration.

FIG. 10A shows a pair of pants having a right pant leg 908 and a left pant leg 910 fitted with the first example sleeve rolling fastener system 900. The flexible strip 904 is secured to the outside of each leg 908, 910, for example by being sewn onto the fabric of the pants. A securing buckle (shown here as first attachment-receiving member 104) is secured on each side of the pants near the waist. In use, the cord 906 is grasped by the user at its bottom end (i.e. at second attachment member element 204B) and pulled upward, thereby telescoping the washers together and with them the underlying pants leg fabric. The second attachment member element 204B is then secured to the first attachment-receiving member 104 as described with respect to FIGS. 3A-3C. Alternatively, a buttonhole 964 may be included in the pants instead of the buckle (first attachment-receiving member 104), and the second attachment member element 204B may be secured to the buttonhole 964 using a button 400 and/or washer 408. The right leg 908 is shown with the first example sleeve rolling fastener system 900 in the unsecured, unrolled position, whereas the left leg 910 is shown with the sleeve rolling fastener system 900 in the secured, rolled-up position.

FIG. 10B shows a pair of pants having a right pant leg 960 and a left pant leg 962 fitted with the second example sleeve rolling fastener system 950 to secure the pants legs in a rolled-up configuration much like in FIG. 10A. The pants include a buttonhole 964, comprising an aperture such as a slit with extra structural reinforcement in some embodiments, at the top of each pant leg 960, 962. The drawstring 954 is pulled to shorten and bunch up the fabric strip 952 of the left pant leg 962, and the loop 956 is secured to the right buttonhole 964 using first and second fastening members 400, 408 as shown in the detail view of FIG. 10C.

FIG. 10C shows a detail view of region "A" shown in FIG. 10B. A first fastening member 400 is used to secure the loop 956 to the buttonhole 964 by passing the head 404 through the aperture 958. A second fastening member 408 is optionally used to secure the first fastening member 400 in place more securely.

Figure 11B:
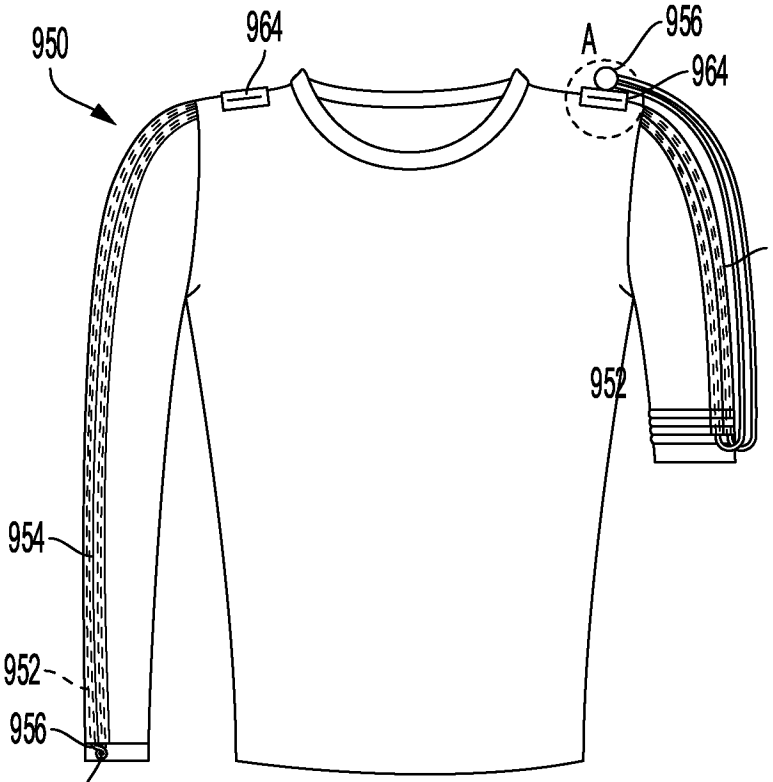
FIG. 11B is a front view of a shirt having sleeves fitted with the second example sleeve rolling fastener system of FIG. 9B.
Figure 11C:
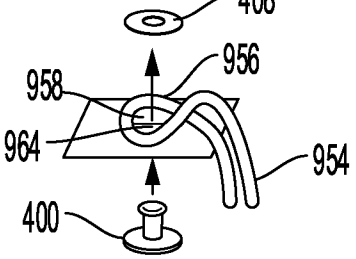
FIG. 11C is a front left side detail view of region "A" of FIG. 11B showing a loop being secured with a first fastening member and second fastening member of FIG. 4A.
Figure 11A:
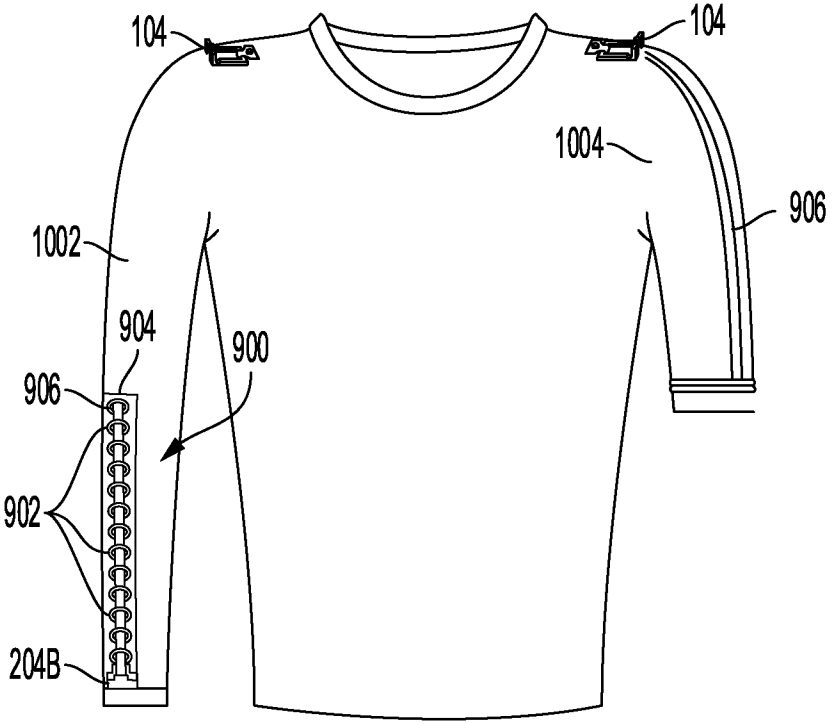
FIG. 11A is a front view of a shirt having sleeves fitted with the first example sleeve rolling fastener system of FIG. 9A.

FIG. 11A shows a shirt having a right sleeve 1002 and a left sleeve 1004 fitted with the first example sleeve rolling fastener system 900. Each sleeve 1002,1004 can be rolled up and secured to a buckle (first attachment-receiving member 104) attached at the shoulder, using the same technique described above with respect to FIG. 10A. Alternatively, a buttonhole 964 may be included in the short instead of the buckle (first attachment-receiving member 104), and the second attachment member element 204B may be secured to the buttonhole 964 using a button 400 and/or washer 408.

FIG. 11B shows a shirt having a right sleeve and a left sleeve fitted with the second example sleeve rolling fastener system 950. Each sleeve can be rolled up and secured to a buttonhole 964 at the shoulder, using the same technique described above with respect to FIG. 10B.

FIG. 11C shows a detail view of region "A" shown in FIG. 11B. A first fastening member 400 is used to secure the loop 956 to the buttonhole 964 by passing the head 404 through the aperture 958. A second fastening member 408 is optionally used to secure the first fastening member 400 in place more securely.

Figure 12:
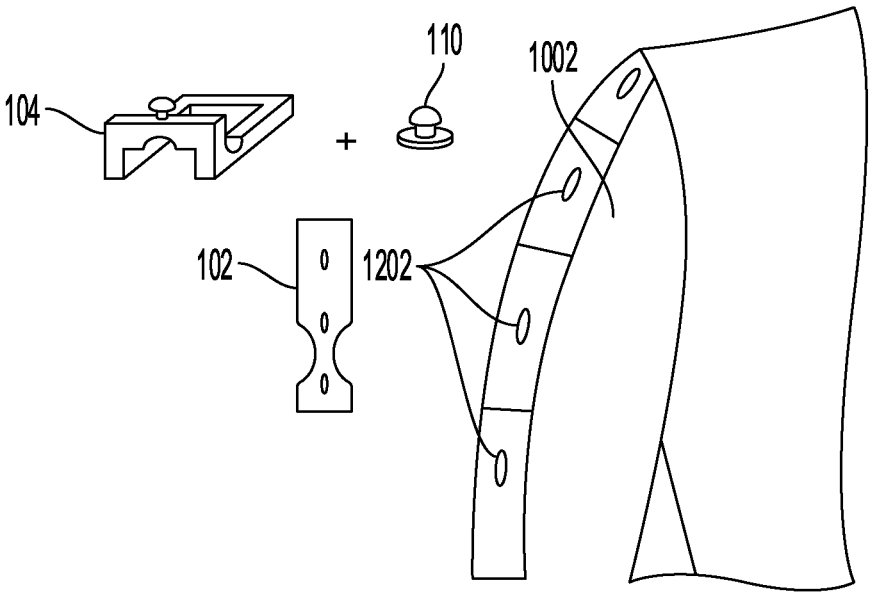
FIG. 12 is a front detail view of a shirt sleeve fitted with the sleeve rolling fastener system embodiment of FIG. 1 showing an example shoulder securing configuration of the sleeve rolling fastener system.

FIG. 12 shows an example shoulder securing configuration of the first example sleeve rolling fastener system 900 of FIG. 11A. The first attachment-receiving member 104 can be attached to the shirt shoulder using any attachments means such as sewing, gluing, bonding etc. However, in this illustrated example, the first attachment-receiving member 104 is attached to a first part 102 as in FIG. 1. The first part 102 is then attached to the shirt shoulder using the third attachment-receiving member 110, which passes through one of a plurality of shirt shoulder apertures 1202 before passing through the first part 102. If a shirt or other article of clothing is equipped with multiple apertures 1202 at the shoulder, waist, or other location where the cord 906 is to be secured, this may allow flexibility to a user in configuring the first example sleeve rolling fastener system 900 to secure its upper end at a preferred location on the article of clothing.

Figure 13:
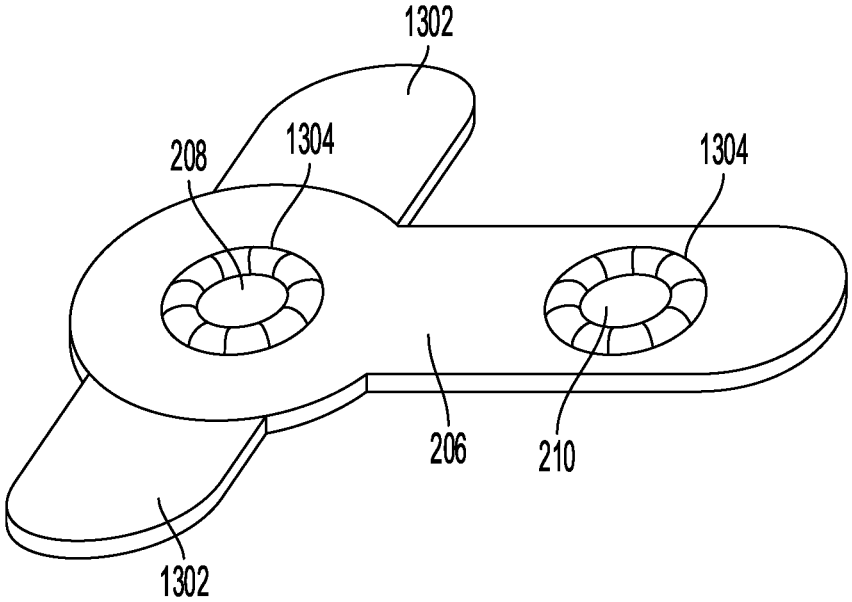
FIG. 13 is a perspective top left side view of the third part of the example embodiment of FIG. 2D showing reinforcing collars around the passage and third part passage and a reinforced pull tab.

FIG. 13 shows an alternative embodiment of the third part 206 of the example embodiment of FIG. 2D. This third part 206 has a collar 1304 around the passage 208 and another collar 1304 around the third part passage 210 for reinforcing the passages 208, 210 and preventing radial tears in the flexible material surrounding the passage 208,210, e.g. when it is being stretched to fit around the head of a button-like element. The illustrated third part 206 also has one or more reinforced pull tabs 1302 for assisting a user in grasping the third part to secure or detach it and to prevent tearing while the third part 206 is being pulled or otherwise handled by the user. These reinforced pull tabs 1302 and collars 1304 may be used in any flexible component of the fastener system to prevent tearing and/or assist a user in grasping the component.

Figure 14A:
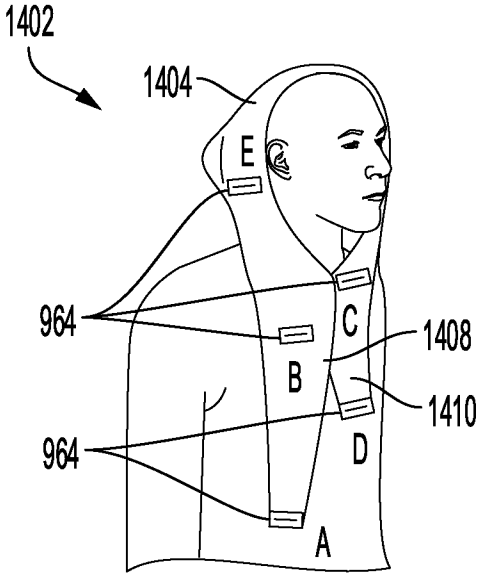
FIG. 14A is a right side view of a sports hijab configured to use the fastener system of FIG. 4A for securing the sports hijab to a user's body.
Figure 14B:
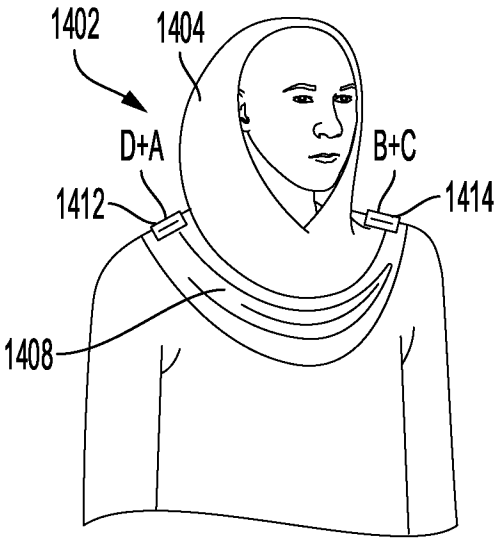
FIG. 14B is a front view of the sports hijab of FIG. 14A secured to the user's body using the fastener system of FIG. 4A.
Figure 14C:
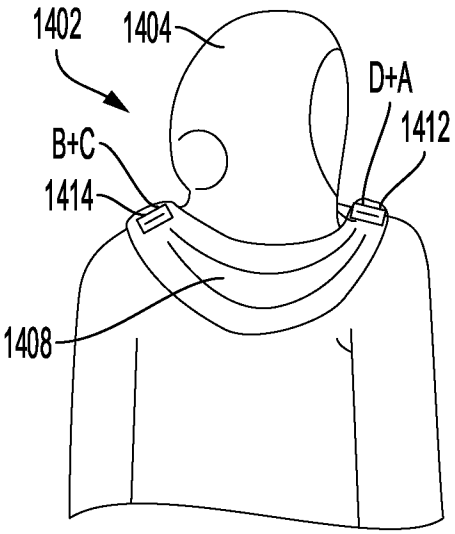
FIG. 14C is a rear view of the sports hijab of FIG. 14A secured to the user's body using the fastener system of FIG. 4A.
Figure 14D:
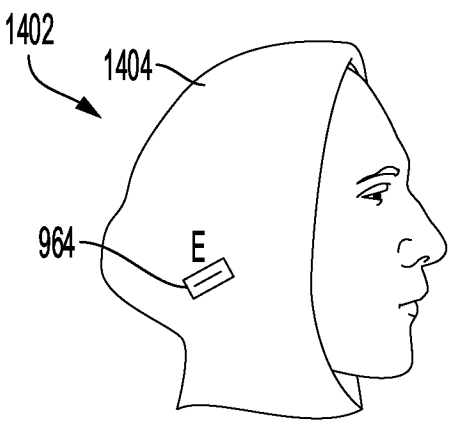
FIG. 14D is a right side view of a head portion of the sports hijab of FIG. 14A showing an aperture for use in securing the sports hijab to the user's body using the fastener system of FIG. 4A.
Figure 14E:
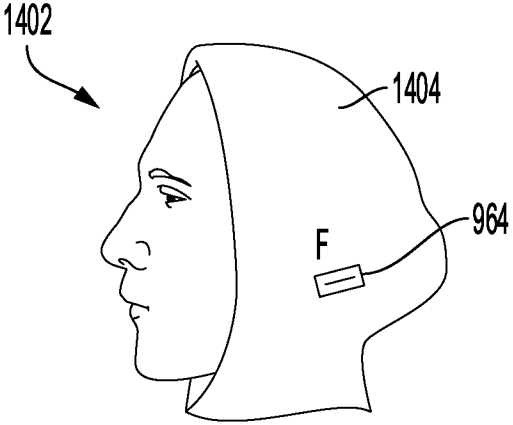
FIG. 14E is a left side view of a head portion of the sports hijab of FIG. 14A showing an aperture for use in securing the sports hijab to the user's body using the fastener system of FIG. 4A.
Figure 14F:
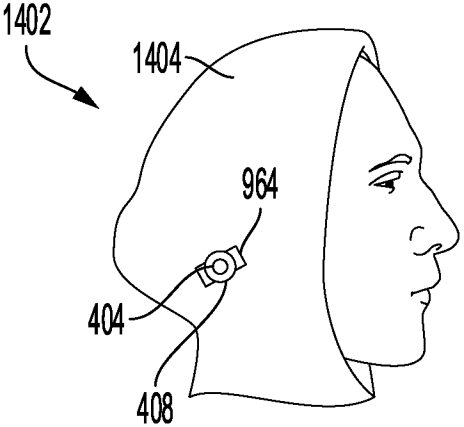
FIG. 14F is a right side view of a head portion of the sports hijab of FIG. 14A showing the aperture being used to secure the sports hijab to the user's body using the fastener system of FIG. 4A.

FIGS. 14A-14F show an application of the fastener system of FIG. 4A-B using a plurality of first fastening members 400 and second fastening members 408 to secure a sports hijab 1402 to a user's body. The sports hijab 1402 includes a head covering portion 1404, a first draping portion 1408 depending from the right side of the head covering portion 1404, and a second draping portion 1410 (shorter than the first draping portion 1408) depending from the left side of the head covering portion 1404. The sports hijab 1402 includes a plurality of buttonholes 964, as in the pants of FIG. 10B and the shirt of FIG. 11B, for use in securing the sports hijab 1402 to the user's body. The head covering portion 1404 includes buttonholes 964 marked "E" (on the right side, also shown in FIG. 14D) and "F" (on the left side, also shown in FIG. 14E); these may be secured to each other behind the user's head by passing the head 404 of a first fastening member 400 through buttonhole "F" and then through buttonhole "E" and securing the head 404 in place using a second fastening member 408 as shown in FIG. 14F. The first draping portion 1408 includes buttonholes 964 marked "B" (shown about half-way down) and "A" (at the bottom end); the second draping portion 1410 includes buttonholes 964 marked "C" (shown at the top end) and "D" (at the bottom end). In use, the first draping portion 1408 may be draped across the user's collar, over the user's left shoulder 1414, and behind the user's back to end at the user's right shoulder 1412, whereas the second draping portion 1410 may be draped across the user's collar to end at the user's right shoulder 1412, such that buttonholes "A" and "D" overlap at the right shoulder 1412 and buttonholes "B" and "C" overlap at the left shoulder 1414. The overlapping buttonholes at the shoulders 1412, 1414 may also each be secured using a first fastening member 400 and second fastening member 408. In some examples, the hijab 1402 includes buttonholes located such that buttons 400 may be used to secure the hijab 1402 to the shirt of FIG. 11A or 11B using the buttonholes placed at the shoulders thereof. More generally, any two articles of clothing or accessories described herein may co-locate buttonholes to assist in fastening one article to another using one or more of the fastener components described herein.

Figure 15A:
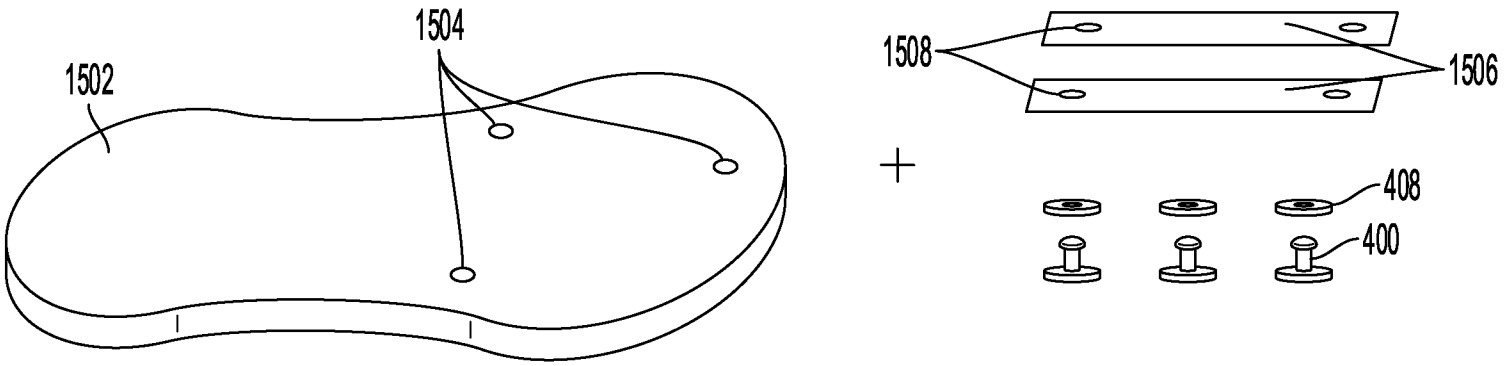
FIG. 15A is an exploded perspective top front view of a flip-flop sandal sole, straps, and fastener system according to the embodiment of FIG. 4A-B.
Figure 15B:
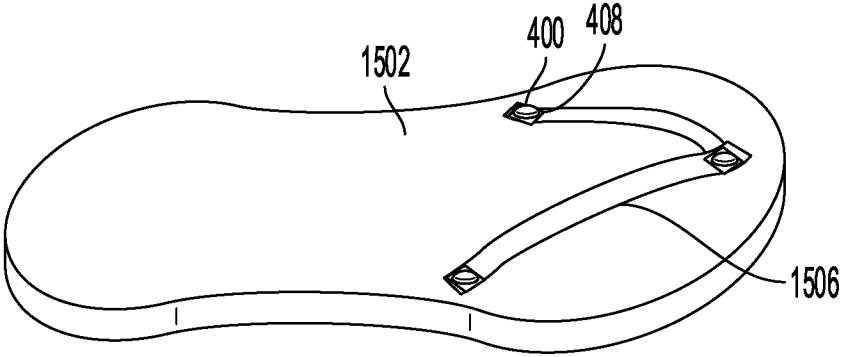
FIG. 15B is a perspective top front view of a flip-flop sandal having its sole secured to its straps using the fastener system according to the embodiment of FIG. 4A-B.

FIGS. 15A-15B show the use of the fastener system of FIG. 4A-B used to secure straps to a sandal sole to assemble a flip-flop sandal. The first fastening members 400 pass through sole apertures 1504 in the sole 1502 and strap apertures 1508 in the straps 1506 and are secured in place with the second fastening members 408.

FIGS. 16A-16F show a head wrap 1600 and a method for securing same using the second example sleeve rolling fastener system 950 of FIG. 9B, demonstrating the versatility of thereof. The head wrap 1600 may be a fabric garment with a head covering portion 1604 and an elongated hair covering portion 1602. The head wrap 1600 may form a roughly tubular shape with an opening at the first end (extending around the forehead and nape of the neck of the user in the drawings) and an opening at the second end (at the far end of the hair covering portion 1602), or it may be closed at the second end. In other embodiments, the head wrap 1600 may be formed from a single flat sheet of fabric that is wrapped around the user's head and hair to form a tubular shape.

The head wrap 1600 includes a first fabric strip 952 of the second example sleeve rolling fastener system 950 between the head covering portion 1604 and the hair covering portion 1602 (with loop 956 marked "A"), and a second fabric strip 952 of the second example sleeve rolling fastener system 950 at the far end (i.e. the second end) of the hair covering portion 1602 (with loop 956 marked "B"). FIG. 16A shows a first step in an example method for securing the head wrap 1600 to the user's head, wherein the fabric strips 952 are fully extended and the hair covering portion 1602 is fully extended. FIG. 16B shows a second step in the example method, in which the loops 956 (indicated by A and B) are pulled to shorten the fabric strips 952, thereby tightening the fabric strips 952 around the user's hair at their respective locations. FIG. 16C shows a third step in the example method, in which arrows 1606 show a twisting movement of the hair covering portion 1602 as the user twists the hair covering portion 1602 into a bun shape. FIG. 16D shows a fourth step in the example method, in which the bun formed by the hair covering portion 1602 is bunched up tight against the user's head with the two drawstrings 954 hanging at the interface between the bun and the head covering portion 1604. FIG. 16E shows a fifth step in the example method, in which the drawstrings 954 are wrapped around the point where the bun meets the head covering portion 1604, with their respective loops 956 "A" and "B" meeting. FIG. 16F shows a sixth step in the example method, in which a first fastening member 400 and second fastening member 408 are used to secure loop 956 "A" to loop 956 "B" to each other by passing the head 404 of the first fastening member 400 through both loops 956 and securing it in place with a second fastening member 408.

Figure 17B:
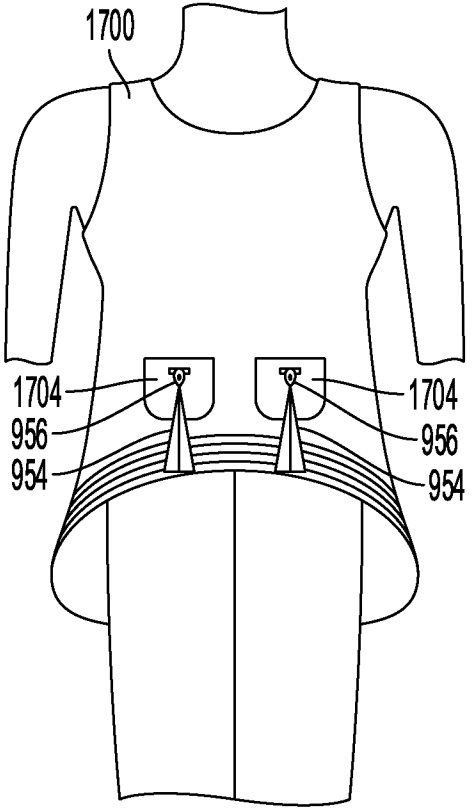
FIG. 17B is a front view of the shirt of FIG. 17A, showing the shirt in a rolled-up and secured position.
Figure 17A:
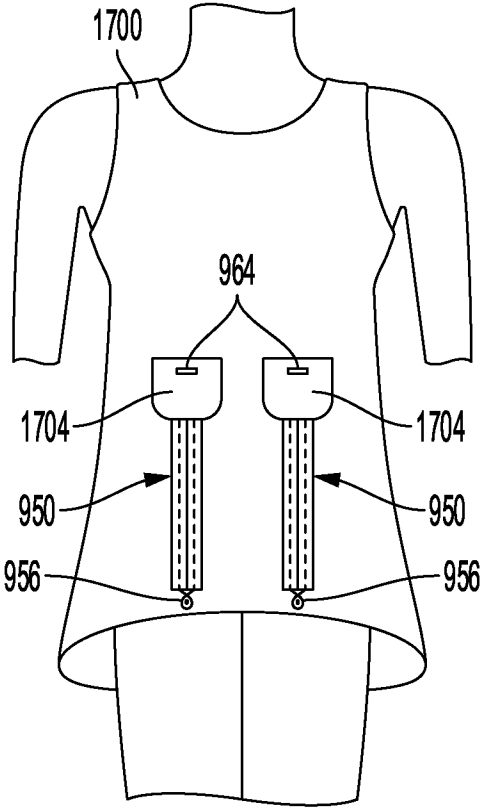
FIG. 17A is a front view of a shirt configured to use the fastener system of FIG. 4A and the second example sleeve rolling fastener system of FIG. 9B for securing the shirt in a rolled-up position, showing the shirt in a rolled-down position.

FIGS. 17A-17B show a shirt 1700 and a method for securing same in a rolled-up position using the second example sleeve rolling fastener system 950 of FIG. 9A. The shirt 1700 includes two pockets 1704, each pocket 1704 having an open top end and a buttonhole 964 formed in its front surface. Below each pocket 1704, sewn into or otherwise secured to the front of the shirt, is a second example sleeve rolling fastener system 950 with the loop 956 at the bottom end. In use, each drawstring 954 can be pulled to shorten the fabric strip 952 and therefore shorten and bunch or roll up the bottom portion of the front surface of the shirt 1700. The loops 956 may then be secured to the buttonholes 964 as described with reference to FIGS. 10C and 11C, thereby securing the shirt with its front bottom portion in a rolled-up configuration.

FIGS. 19A-D show example fastening members suitable for use as part of the example fastener system of FIG. 4A.

Figure 19D:
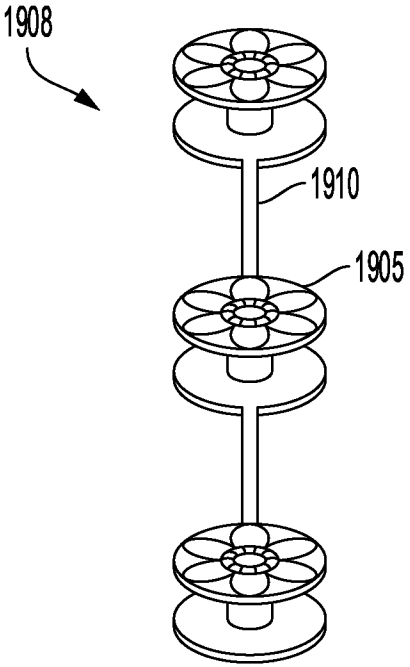
FIG. 19D is a top front perspective view of an example decorative third fastening member suitable for use with the first fastening member of the fastening system of FIG. 4A.
Figure 19C:
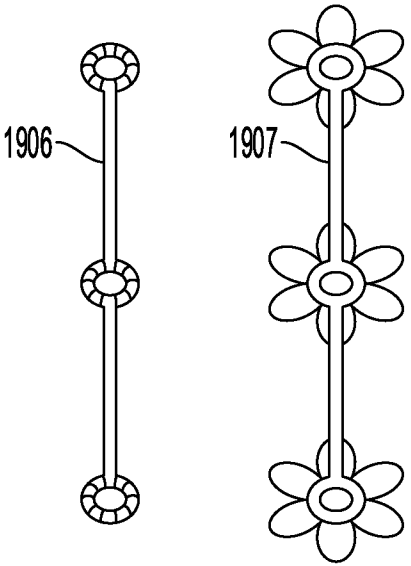
FIG. 19C is a front view of two example second fastening members suitable for use with the first fastening member of the fastening system of FIG. 4A.
Figure 19B:
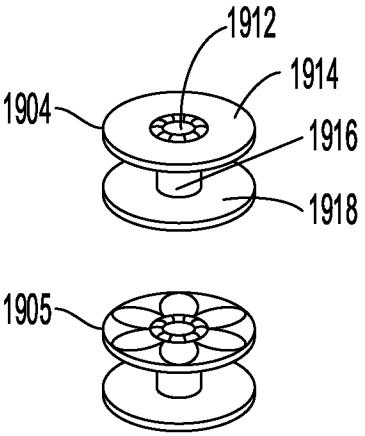
FIG. 19B is a top front perspective view of two example third fastening members suitable for use with the first fastening member of the fastening system of FIG. 4A.
Figure 19A:
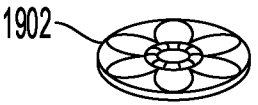
FIG. 19A is a top front perspective view of an example decorative second fastening member suitable for use with the first fastening member of the fastening system of FIG. 4A.

FIG. 19A shows an example decorative second fastening member 1902 (i.e. a variant of washer 408) suitable for use with a first fastening member 400. The decorative second fastening member 1902 includes an aperture in the center for receiving the head 404 and neck 402 portions of a first fastening member 400. The aperture may be reinforced around its circumference by a reinforced collar, as in the example of FIG. 13. The top surface of the decorative second fastening member 1902 may include a decorative design, shown here as a floral design. As in other examples, the decorative second fastening member 1902 may be formed at least in part from silicone or a similarly elastic material to facilitate passage therethrough of the head portion 404 of the first fastening member 400 and tight gripping of the neck portion 402 thereof. It will be appreciated that the decorative second fastening member 1902 may provide an aesthetic stylistic visual element to a fastener of a garment or accessory that may be changed or swapped out based on the user's current aesthetic preferences.

FIG. 19B shows a third fastening member 1904 and a decorative third fastening member 1905 suitable for use with the first fastening member of the fastening system of FIG. 4A. The third fastening member 1904 and decorative third fastening member 1905 are each formed from an elastic material such as silicone, having a head 1914, neck 1916, and base 1918, and each defines a vertical passage 1912 through the center thereof, much like a bobbin. The passage 1912 is configured to allow the head portion 404 of a first fastening member 400 to pass therethrough, such that the neck portion 402 thereof fills the passage (i.e. the interior of the neck 1916), the head portion 404 rests on top of the head 1914 of the third fastening member 1904, 1905, and the base portion 406 rests below the base 1918 of the third fastening member 1904, 1905. The third fastening member 1904 differs from the decorative third fastening member 1905 insofar as the decorative third fastening member 1905 includes a decorative top surface like decorative second fastening member 1902.

Figure 18B:
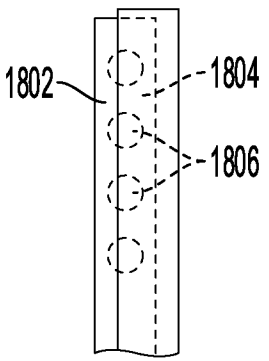
FIG. 18B is a rear detail view of a two-layer fabric strip of the left breast closure of the example coat of FIG. 18A, showing the locations of first fastening members between the two fabric layers.
Figure 18D:
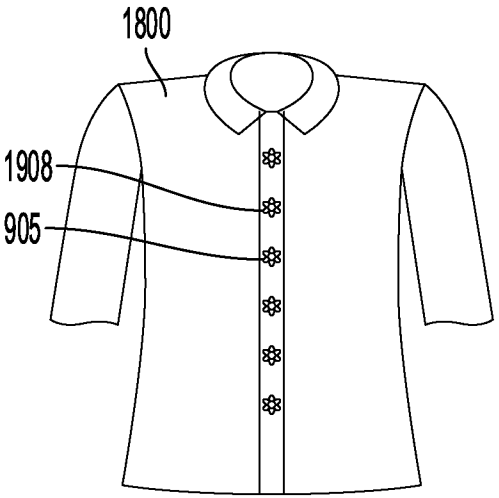
FIG. 18D is a front view of the example coat of FIG. 18A, showing the coat secured in a closed position as a result of the method of securing the coat.
Figure 18A:
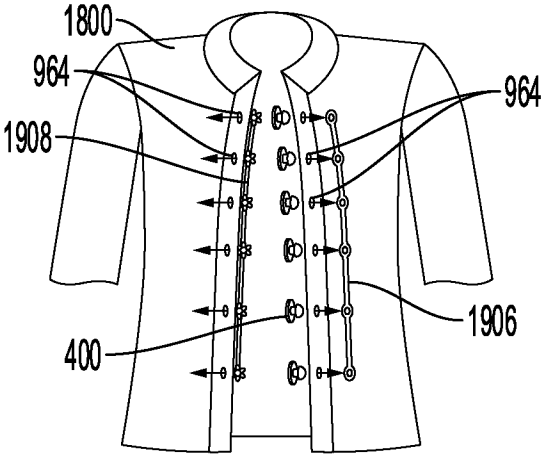
FIG. 18A is a front exploded view of an example coat, showing a first step in a method of securing the coat using a plurality of first fastening members of the fastener system of FIG. 4A, a second fastening member of FIG. 19C, and a third fastening member of FIG. 19D.
Figure 18C:
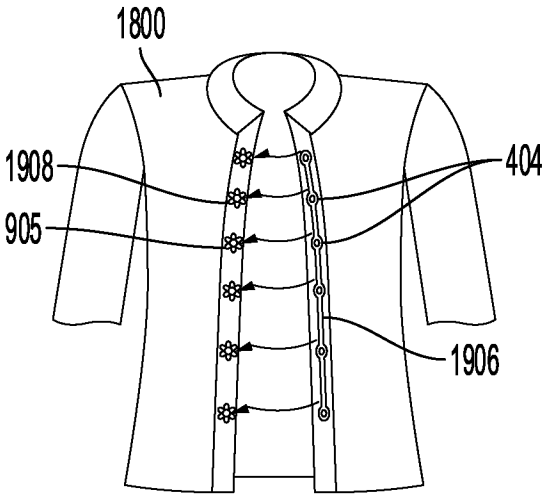
FIG. 18C is a front view of the example coat of FIG. 18A, showing a second step in the method of securing the coat using the plurality of first fastening members of the fastener system of FIG. 4A, a second fastening member of FIG. 19C, and a third fastening member of FIG. 19D.

FIG. 19C shows an alternative example second fastening member 1906 and an alternative example decorative second fastening member 1907 suitable for use with the first fastening member 400. The alternative second fastening members 1906, 1907 shown here include multiple washer-style second fastening members 408 tethered together by a strip or line of flexible or semi-rigid elastic material such as silicone. The alternative second fastening members 1906, 1907 may space the washers 408 apart by a distance configured to match the distances of buttonholes of a known garment or other article, such as the coat 1800 of FIGS. 18A-D described below, or to secure a complementary line of studs (e.g. multiple buttons 400 or decorative third fastening member 1908, described below) in place.

FIG. 19D shows an example decorative third fastening member 1908, consisting of a plurality of third fastening members 1904 or (as shown here) decorative third fastening members 1905 tethered together by a strip 1910 of flexible or semi-rigid elastic material like the alternative second fastening members 1906, 1907 of FIG. 19C.

FIG. 18A is a front exploded view of an example coat, showing a first step in a method of securing the coat using a plurality of first fastening members of the fastener system of FIG. 4A, a second fastening member of FIG. 19C, and a third fastening member of FIG. 19D.

FIGS. 18A-18D show a coat 1800 and a method for securing a front seam of same using components of the fastener system of FIG. 4A and FIGS. 19A-D. The coat 1800 may be another garment such as a shirt, sweater, or jacket in some embodiments, and the same principles shown in FIGS. 18A-18D may be applied to secure any seam in a closed configuration.

The coat has a front seam with left edge and a right edge. The left edge includes a plurality of buttonholes 964, and may include a double-layered fabric strip as described below with reference to FIG. 18B. The right edge also includes a plurality of buttonholes 964.

FIG. 18A shows a first step in a method for securing the seam of the coat 1800 in a closed position. In use, a plurality of first fastening members 400 may have their heads 404 passed through the buttonholes 964 of the left edge (from the inside to the outside) and secured in place using a plurality of second fastening members 408 or, as shown here, an alternative example second fastening member 1906 (or an alternative example decorative second fastening member 1907). A decorative third fastening member 1908 is secured to the right edge by passing the head 1914 and neck 1916 of each decorative third fastening member 1905 thereof through a respective buttonhole 964 of the right edge (from the inside to the outside), such that the fabric of the right edge of the coat rests between the head 1914 and base 1918 of each decorative third fastening member 1905 of the decorative third fastening member 1908. The decorative third fastening member 1908 may thereby be held in place, secured to the coat 1800, regardless of whether the front seam of the coat 1800 is open or closed.

FIG. 18B is a rear detail view of a two-layer fabric strip of the left edge of the coat 1800, showing the locations of the first fastening members 400 between the two fabric layers. In some embodiments, the coat 1800 may include the two-layer fabric strip in its left edge, consisting of an inside strip 1804 and an outside strip 1802 of fabric. The inside strip 1804 is positioned against the wearer's body and serves as a cushion between the bases 406 of the first fastening members 400 (shown at positions 1806) and the wearer's body. The outside strip 1802 includes the buttonholes 964 (not visible) through which the heads 404 and necks 402 of the first fastening members 400 pass.

FIG. 18C shows a second step in the method of securing the coat 1800. The head portions 404 of the first fastening members 400 secured to the left edge of the coat seam are pushed through the apertures of the respective decorative third fastening members 1905 of the decorative third fastening member 1908 secured to the right edge of the coat seam, such that each head 404 protrudes from the front of the right edge. FIG. 18D shows the coat 1800 with its front seam secured in a closed position as a result of the method of securing the coat in FIGS. 18A and 18C.

Figure 20A:
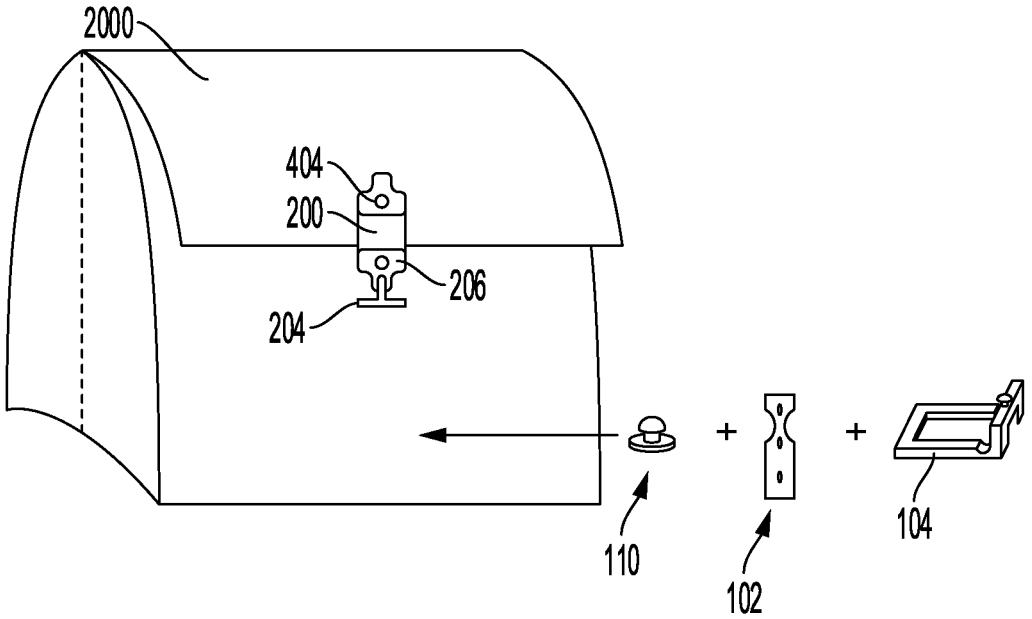
FIG. 20A is a front right side perspective partially exploded view of an example handbag and the fastening system of FIGS. 1-3C and 5A-8C.
Figure 20B:
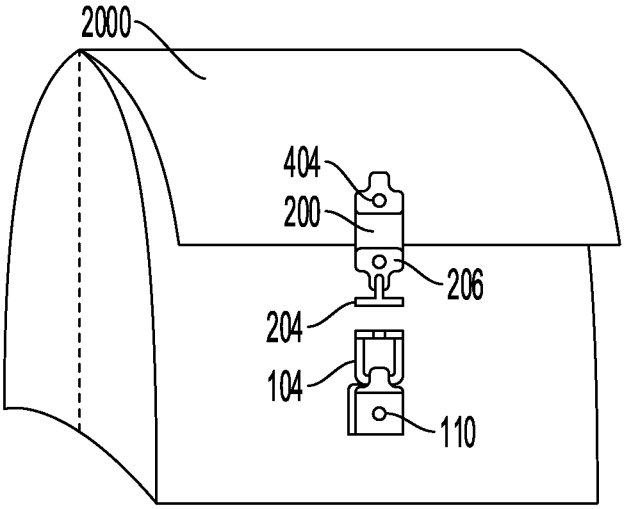
FIG. 20B is a front right side perspective assembled view of the example handbag of FIG. 20A using the fastening system of FIGS. 1-3C and 5A-8C.

FIG. 20A shows an example handbag 2000 using the fastening system of FIGS. 1-3C and 5A-8C to secure a flap or opening of the handbag 2000. The components 110, 200, 204, and 206 of the second member are shown assembled on the flap; the components 110, 102, and 104 of the first member 100 are shown disassembled. FIG. 20B is an assembled view of the handbag 2000 of FIG. 20A showing the first member and second member of the fastening system in place as a clasp for securing the flap.

Figure 21A:
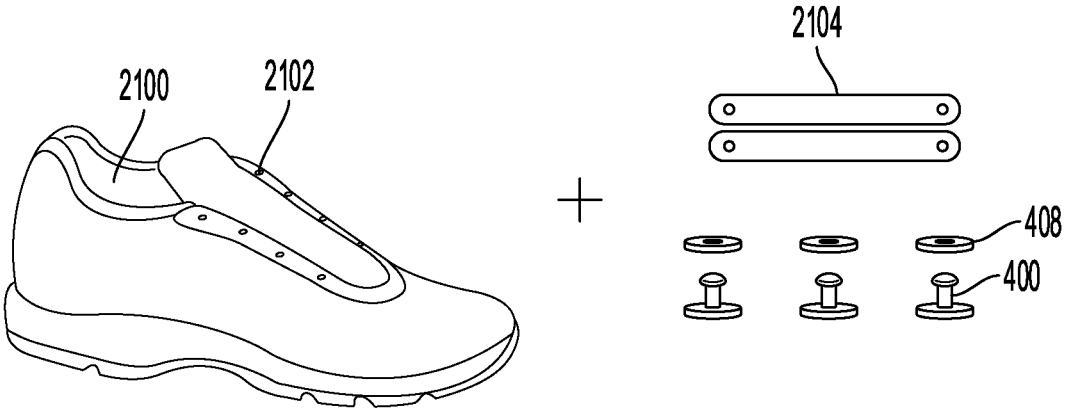
FIG. 21A is a top right side perspective partially exploded view of an example shoe with a plurality of shoe securing strips and a plurality of the first and second fastening members of FIG. 4A.
Figure 21B:
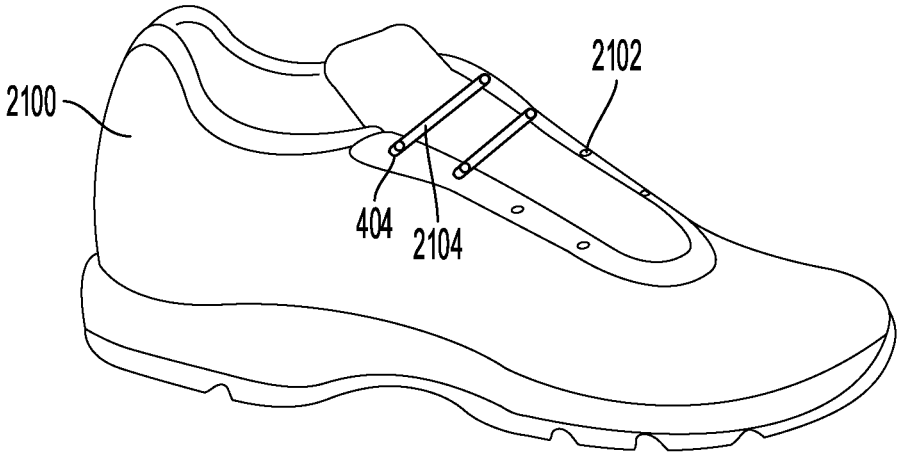
FIG. 21B is a top right side perspective partially assembled view of the example shoe of FIG. 21A secured with the plurality of shoe securing strips and the plurality of the first and second fastening members of FIG. 4A.

FIG. 21A shows an example shoe 2100 with a plurality of shoelace holes 2102, as well as a plurality of securing strips 2104 and a plurality of the first and second fastening members 400, 408. Each securing strip 2104 is a strip of flexible material, such as fabric, with a buttonhole at either end. FIG. 21B shows the example shoe 2100 of FIG. 21A secured with the plurality of shoe securing strips 2104 securing the shoe 2100 by passing a head 404 of each first fastening member 400 through a respective shoelace hole 2102 and a respective buttonhole at the end of a securing strip 2104 and securing the head 404 with a second fastening member 408.

Figure 22A:
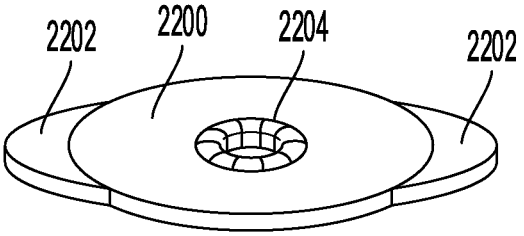
FIG. 22A is a top front perspective view of an example reinforced tabbed second fastening member suitable for use with the fastening system of FIG. 4A.
Figure 22B:
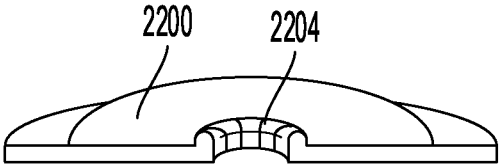
FIG. 22B is a top front perspective cutaway view of the example reinforced tabbed second fastening member of FIG. 22A.
Figure 22C:
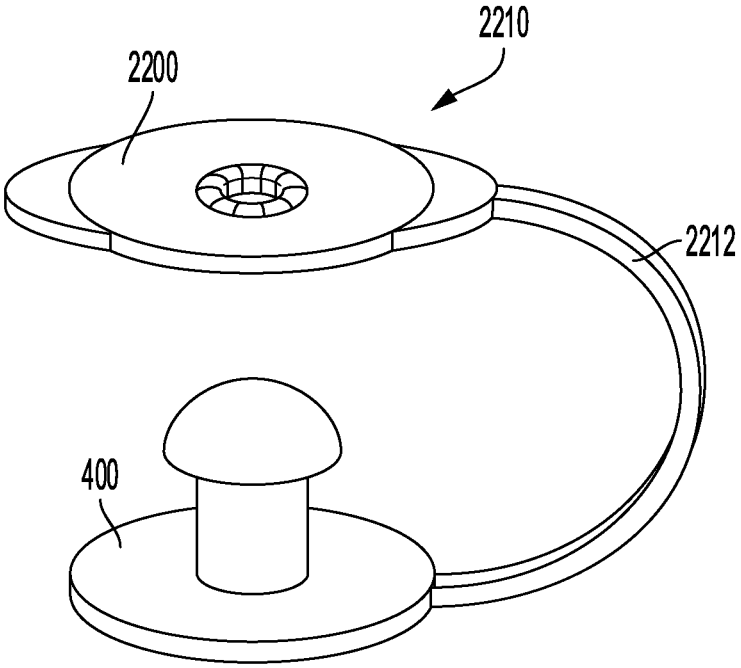
FIG. 22C is a top front perspective view of an example reinforced tabbed second fastening member tethered to a first fastening member of FIG. 4A.

FIG. 22A shows a reinforced tabbed second fastening member 2200 suitable for use with the fastening system of FIG. 4A. The reinforced tabbed second fastening member 2200 includes two tabs 2202 and a reinforced collar 2204, as described above with reference to FIG. 13. FIG. 22B is a cutaway view of the example reinforced tabbed second fastening member 2200 of FIG. 22A showing the reinforced collar 2204 in cross-section. FIG. 22C shows a tethered fastener 2210 comprising the reinforced tabbed second fastening member 2200 tethered to a first fastening member 400 by a tether 2212. The tether 2212 may be formed from a flexible or semi-rigid material such as silicone, fabric, or thin metal.

Figure 23:
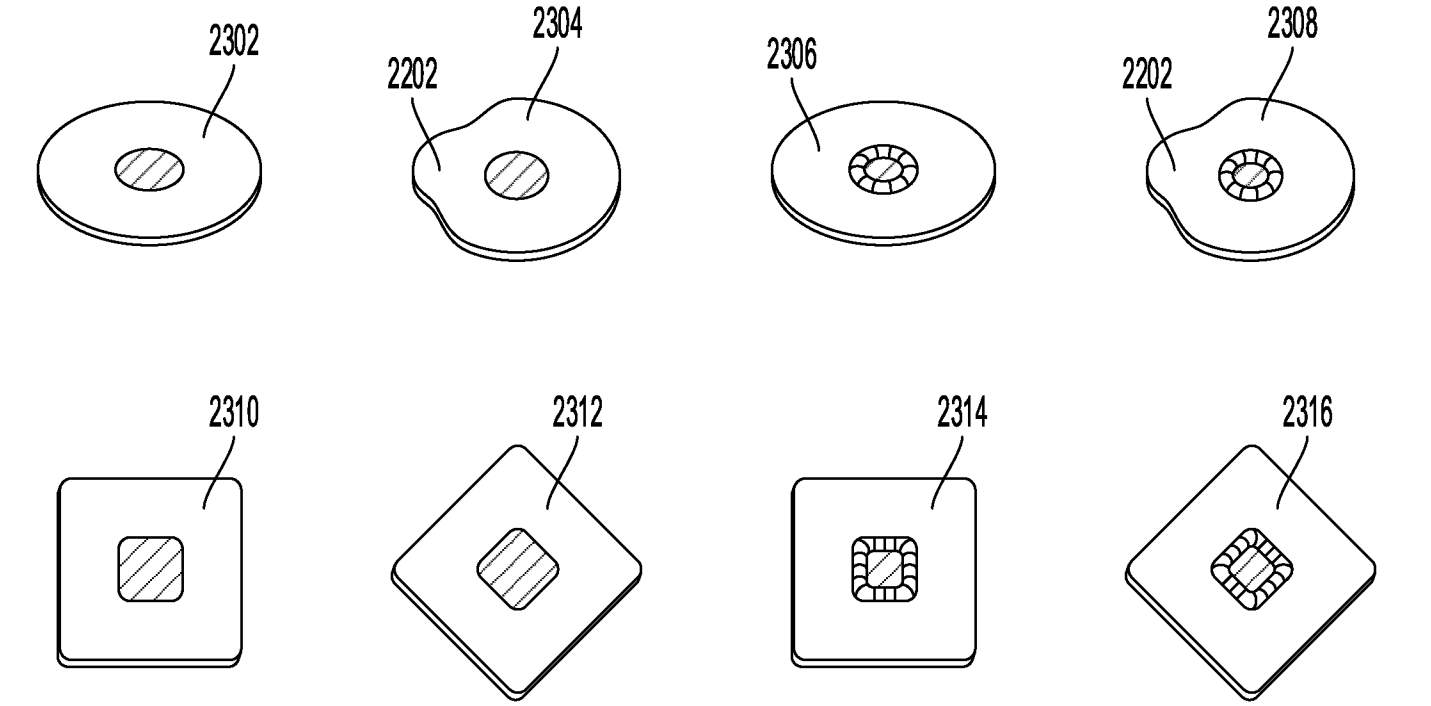
FIG. 23 is a top front perspective view of example alternative second fastening members suitable for use with the fastening system of FIG. 4A.

FIG. 23 shows example alternative second fastening members suitable for use with the fastening system of FIG. 4A. A disc-shaped second fastening member 2302 is similar to washer 408 but may have a wider ring portion relative to the size of the passage defined therethrough. A tabbed disc-shaped second fastening member 2304 is similar to the disc-shaped second fastening member 2302 but includes a tab 2202 as previously described. A reinforced disc-shaped second fastening member 2306 is similar to the disc-shaped second fastening member 2302 but includes a reinforced collar as previously described. A reinforced tabbed disc-shaped second fastening member 2308 is similar to the disc-shaped second fastening member 2302 but includes a tab 2202 and a reinforced collar as previously described. Square second fastening member 2310 is similar to washer 408 but has a rectangular or square shape and may define a square passage instead of a round passage for use with first fastening members 400 having a neck 402 that is square in cross-section. The square second fastening member 2310 may also be used rotated 45 degrees to a diamond position as a diamond-shaped second fastening member 2312. A reinforced square second fastening member 2314 is similar to the square second fastening member 2310 but includes a reinforced collar as previously described, and may be used rotated 45 degrees as a reinforced diamond-shaped second fastening member 2316. By including multiple shapes and/or sizes of second fastening members in the fastener system, different functional and aesthetic preferences may be satisfied.

The various rigid components of the fastener systems described above may be formed from a rigid or semi-rigid material, including non-synthetic materials such as metal, wood, or rubber, or synthetic materials such as silicone rubber. These components may include the various button elements (e.g. third attachment-receiving member 110, second attachment-receiving member 108, and first fastening member 400), the various buckle elements (e.g. first attachment-receiving member 104 and buckle 510), the various attachment members (e.g. attachment member 204, first attachment member element 204A, and second attachment member element 204B), and the rigid washer components (e.g. washers 902).

The various flexible components of the fastener systems described above may be formed from a non-synthetic elastic material, including cotton, wool, leather, or rubber, or a synthetic elastic material such as silicone rubber. These components may include the various strap elements (e.g. first part 102, second part 202, third part 206, and flexible strip 904), the cord components (e.g. cord 906), and the flexible washer components (e.g. second fastening member 408). In some embodiments, the interior portion of the attachment member 204 (e.g. first attachment member element 204A) may also be flexible and formed from a suitable synthetic or non-synthetic elastic material such as leather, rubber, or metal wire.

In each example above using one of the various button elements (third attachment-receiving member 110, second attachment-receiving member 108, and first fastening member 400) to secure another component, the use of second fastening member 408 may be used to improve the interference fit or in some cases may be omitted. For example, when the button element passes through an aperture or passage in the item being secured, in some cases the second fastening member 408 may be unnecessary.

Although various components of the example devices and systems are described and illustrated as a single component, in other embodiments their functions may be split among multiple different components.

Note that any and all of the embodiments described above can be combined with each other, except to the extent that it may be stated otherwise above or to the extent that any such embodiments might be mutually exclusive in function and/or structure.

Although the present invention has been described with reference to specific exemplary embodiments, it will be recognized that the invention is not limited to the embodiments described, but can be practiced with modification and alteration within the spirit and scope of the appended claims. Accordingly, the specification and drawings are to be regarded in an illustrative sense rather than a restrictive sense.

The invention claimed is:

1. A fastener system comprising:

a first member comprising:

a first part attached to a first attachment-receiving member;

the first attachment-receiving member having a passage, and a second attachment-receiving member; and a second member comprising:

an attachment member;

a second part attached to the attachment member; and a third part attached to the attachment member;

the passage permitting the attachment member in a first orientation to pass, and preventing the attachment member in a second orientation from passing; and the third part capable of fastening to the second attachment-receiving member to secure the attachment member in the second orientation.

2. The fastener system of claim 1, wherein the attachment member is t-shaped.

3. The fastener system of claim 1, wherein the first attachment-receiving member further comprises a groove capable of receiving the attachment member.

4. The fastener system of claim 1, wherein the first part, the second part, the first attachment-receiving member and the attachment member are washable.

5. The fastener system of claim 1, wherein the first part, the second part, the first attachment-receiving member and the attachment member comprise non-synthetic materials.

6. The fastener system of claim 1, wherein the second part further comprises an attachment region distal from the first attachment-receiving member adapted to attach to a further article.

7. The fastener system of claim 1, wherein the first part further comprises an attachment region distal from the attachment member adapted to attach to a further article.

8. The fastener system of claim 1, further comprising:

a wearable article, connected at a first end to a first end of the first part distal from the first attachment-receiving member; and connected at a second end to a first end of the second part distal from the attachment member.

9. The fastener system of claim 8, wherein the wearable article is an article of clothing.

10. The fastener system of claim 8, wherein the wearable article is an accessory.

11. The fastener system of claim 8, wherein the wearable article is wearable equipment.

12. The fastener system of claim 8, wherein the second attachment-receiving member protrudes from the first attachment-receiving member and comprises:

a head portion distal from the first attachment-receiving member; and a neck portion, the head portion having a larger cross sectional area compared to the neck portion.

13. A kit comprising:

a first fastener system comprising:

a first member comprising:

a first part attached to a first attachment-receiving member;

the first attachment-receiving member having a passage, and a second attachment-receiving member; and a second member comprising:

an attachment member;

a second part attached to the attachment member; and a third part attached to the attachment member;

the passage permitting the attachment member in a first orientation to pass, and preventing the attachment member in a second orientation from passing; and the third part capable of fastening to the second attachment-receiving member to secure the attachment member in the second orientation; and a second fastener system comprising:

a first fastening member comprising:

a first fastening part having a first end and a second end; and a second fastening part connected to the second end;

a second fastening member adapted to secure a first article by passing over at least the first article and the second fastening part and achieving an interference fit with the first fastening part.

14. The kit of claim 13, wherein the second fastening part has a cross sectional area larger than the second end of the first fastening part.

15. The kit of claim 13, wherein the second fastening member comprises a non-synthetic material.

16. The kit of claim 13, wherein the second fastening member is an o-ring and the second fastening part is circular.

17. The kit of claim 13, wherein the first article is a scarf.

18. The kit of claim 13, wherein the first article is a hijab.

19. The kit of claim 13, wherein:

the second fastener system is adapted to secure the first part or second part of the first fastener system to the first article.

20. A method of securing a hijab to a user, the hijab comprising a head covering portion, a first draping portion depending from a first side of the head covering portion, and a second draping portion depending from a second side of the head covering portion, the method comprising:

extending the first draping portion in front of the user's collar, over the user's shoulder proximate to the second side, and behind the user's back to the user's shoulder proximate to the first side;

extending the second draping portion to the user's shoulder proximate to the first side;

securing the first draping portion to the second draping portion at the user's shoulder proximate to the second side using a fastener system comprising a first fastening member and a second fastening member, the first fastening member comprising:

a first fastening part having a first end and a second end; and a second fastening part connected to the second end;

the second fastening member being adapted to secure the first draping portion to the second draping portion by passing over at least the first draping portion, the second draping portion, and the second fastening part and achieving an interference fit with the first fastening part; and securing the first draping portion to the second draping portion at the user's shoulder proximate to the first side using another of said first fastening member and another of said second fastening member.

* * * * *